United States Patent [19]

Hosaka

[11] Patent Number: 4,625,697

[45] Date of Patent: Dec. 2, 1986

[54] AUTOMOTIVE ENGINE CONTROL SYSTEM CAPABLE OF DETECTING SPECIFIC ENGINE OPERATING CONDITIONS AND PROJECTING SUBSEQUENT ENGINE OPERATING PATTERNS

[75] Inventor: Akio Hosaka, Yokohama, Japan

[73] Assignee: Nissan Motor Company, Limited, Kanagawa, Japan

[21] Appl. No.: 666,367

[22] Filed: Oct. 30, 1984

[30] Foreign Application Priority Data

| | | | |
|---|---|---|---|
| Nov. 4, 1983 | [JP] | Japan | 58-205927 |
| Nov. 4, 1983 | [JP] | Japan | 58-205928 |
| Nov. 4, 1983 | [JP] | Japan | 58-205929 |

[51] Int. Cl.[4] ..... F02M 51/00

[52] U.S. Cl. ..... 123/478; 123/480; 123/486; 123/339

[58] Field of Search ..... 123/440, 478, 486, 349, 123/339, 395, 417, 489, 479, 480

[56] References Cited

U.S. PATENT DOCUMENTS

| | | | |
|---|---|---|---|
| Re. 31,582 | 5/1984 | Hosaka et al. | 364/431.04 |
| 4,130,095 | 12/1978 | Bowler et al. | 123/440 |
| 4,235,234 | 11/1980 | Rice | 123/486 |
| 4,319,327 | 3/1982 | Higashiyama et al. | 364/431.05 |
| 4,344,398 | 8/1982 | Ikeura | 123/339 |
| 4,345,557 | 8/1982 | Ikeura | 123/339 |
| 4,376,428 | 3/1983 | Hata et al. | 123/417 |
| 4,402,217 | 9/1983 | Higashiyama et al. | 73/117.3 |
| 4,402,289 | 9/1983 | Ikeura | 123/339 |
| 4,406,261 | 9/1983 | Ikeura | 123/339 |
| 4,406,262 | 9/1983 | Ikeura | 123/339 |
| 4,459,670 | 7/1984 | Yamaguchi et al. | 364/431.10 |

FOREIGN PATENT DOCUMENTS

| | | |
|---|---|---|
| 0058826 | 9/1982 | European Pat. Off. . |
| 0081648 | 6/1983 | European Pat. Off. . |
| 0084116 | 7/1983 | European Pat. Off. . |
| 0085909 | 8/1983 | European Pat. Off. . |
| 2949988 | 7/1980 | Fed. Rep. of Germany . |
| 3333392 | 3/1984 | Fed. Rep. of Germany . |
| 49-40886 | 11/1974 | Japan . |
| 2125578 | 3/1984 | United Kingdom . |

OTHER PUBLICATIONS

SAE Technical Paper Series, 800825, Digital Engine Controller (date unavailable).

Ser. No. 655,554 filed 9/28/84, by Hara.

Ser. No. 445,552 filed 11/30/82, by Ito.

SAE Paper 800056 of Feb. '80, "Microprocessor Control Brings About Better Fuel Economy With Good Drivability".

*Primary Examiner*—Raymond A. Nelli

*Attorney, Agent, or Firm*—Schwartz, Jeffery, Schwaab, Mack, Blumenthal & Evans

[57] ABSTRACT

An engine control system monitors engine operation by periodically sampling engine operating parameters and records variation patterns of the engine operating parameters as engine operation pattern data whenever any of a number of preselected specific engine operating conditions occur, such as engine stalling, acceleration, or deceleration. The control system normally controls the engine according to conventional engine control procedures and adjusts the control procedures in response to preselected engine operating conditions in accordance with a projected engine operation pattern derived from prerecorded engine operation pattern data and the detected specific engine operating condition. The engine operation pattern data may be repeatedly updated and/or accumulated during engine operation and may be held in a memory of the control system even after the engine is turned off. The engine operating parameters may include the operation state of one or more vehicle components influencing engine operation, such as an air conditioner with a compressor driver by the engine and so acting as an additional load on the engine, or a transmission, the gear position of which can change engine operation significantly.

27 Claims, 26 Drawing Figures

AUTOMOTIVE ENGINE CONTROL SYSTEM CAPABLE OF DETECTING SPECIFIC ENGINE OPERATING CONDITIONS AND PROJECTING SUBSEQUENT ENGINE OPERATING PATTERNS

BACKGROUND OF THE INVENTION

The present invention relates generally to an electronic control system for an automotive internal combustion engine for controlling fuel injection, air induction, spark ignition, and exhaust gas recirculation, with excellent response characteristics. More particularly, the invention relates to an engine control system which, under special engine operating conditions, assumes that subsequent engine operation will follow prerecorded patterns and initiates or expedites special engine control procedures in accordance with the assumed engine operation pattern.

SAE Papers 800056 and 800825, published by Society of Automotive Engineers discloses electronic control systems for internal combustion engines for controlling fuel supply, fuel injection, auxiliary air flow, spark ignition, exhaust gas recirculation and so forth according to predetermined engine control parameters. Control may be performed in closed loops and/or open loops to derive control signals for each of the engine operating elements controlled depending upon the engine operating conditions. In such control systems, the engine operating conditions to be detected have already occurred some time before they are actually detected. Response lags occur in the control system as well as in the element to be controlled. Such lags may be significant when the engine is under critical conditions.

Numerous experiences of engine stalling under certain driving conditions have been reported such as under relatively heavy load conditions while driving the compressor of an air conditioner, the alternator, the radiator fan and so forth. In modern vehicles, the load on the engine tends to be increased by installation of power steering which requires an engine-driven pump, air-conditioning which requires a compressor driven by the engine, a relatively high-capacity alternator for generating electric power at high ratings, and so forth. Furthermore, increases in the electrically operated accessories such as automotive audio systems, high-capacity blowers for the air conditioner, and so forth, affect engine operation by lowering the supply voltage for an ignition system which may cause engine stalling.

An engine stall preventive engine control system has been proposed in Published Japanese Patent (Tokko) No. Showa 49-40886, published on Nov. 6, 1974. In the disclosed system, actual engine speed is compared with a predetermined threshold. When the engine speed drops below the threshold, a stall-preventing operation is performed. In the stall-preventing operation, an auxiliary air flow rate is increased and/or the fuel supply or fuel injection quantity is increased to increase engine output torque.

However, in the control system of the above-mentioned Published Japanese Patent, excessive time lags, which may prevent successful execution of the engine stall-preventing operation, exist due to the nature of the engine itself. For instance, after a control signal is issued to increase the auxiliary air flow rate, the auxiliary air control valve is actuated so as to allow an increased rate of air flow, but only after a certain time lag. The increase in the of auxiliary air flow rate is recognized only after another time lag. After another time lag, the fuel is increased. Finally, engine torque increases to a sufficient level to prevent the engine from stalling. However, the accumulated time lag may be sufficient to allow the engine to stall due to response delays.

In addition, in the aforementioned stall preventing operation, engine operation fluctuates significantly due to response delays in increasing the air flow rate and fuel supply amount and due to significant deviation of air/fuel ratio from the stoichiometric value. This further prevents successful stall pevention.

SUMMARY OF THE INVENTION

It is an object of the invention to provide an automotive engine control system with improved response characteristics by projecting engine operation patterns subsequent to specific engine operating condition.

Another object of the present invention is to provide an engine control system capable of updating and/or accumulating engine operation pattern data representing projected engine behavior subsequent to specific engine operating conditions.

A further object of the invention is to provide a process for performing engine control including projection of engine operation patterns subsequent to specific engine operating conditions and modifying the engine control on the basis of the projected engine operation pattern so as to optimize engine performance and/or prevent undesirable engine behavior.

In order to accomplish the above-mentioned and other objects, an engine control system, according to the present invention, monitors engine operation by periodically sampling engine operating parameters and records variation patterns of the engine operating parameters as engine operation pattern data whenever any of a number of preselected specific engine operating conditions occur, such as engine stalling, acceleration, or deceleration. The control system normally controls the engine according to conventional engine control procedures and adjusts the control procedures in response to preselected engine operating conditions in accordance with a projected engine operation pattern derived from prerecorded engine operation pattern data and the detected specific engine operating condition.

The engine operation pattern data may be repeatedly updated and/or accumulated during engine operation and may be held in a memory of the control system even after the engine is turned off.

The engine operating parameters may include the operation state of one or more vehicle components influencing engine operation, such as an air conditioner with a compressor driver by the engine and so acting as an additional load on the engine, or a transmission, the gear position of which can change engine operation significantly.

The control procedures executed when the specific engine operating condition is detected may include control of the aforementioned vehicle components.

According to one aspect of the invention, an electronic engine control system for an internal combustion engine comprises means for monitoring a preselected engine operating parameter and producing a first signal indicative thereof, means for sampling the first signal and producing and recording engine operation pattern data including first engine operating parameter-indicative data and a second time-indicative component, means for presetting a model pattern including components corresponding to those in the engine operation pattern data and representing a preselected engine operating condition, means for comparing the engine operation pattern data with the model pattern to judge if the engine operation pattern data approximately matches the model pattern, and means for performing control and fail-safe operations for the engine, normally solely on the basis of the first signal, and on the basis of the first signal and the model pattern when the engine operation pattern approximately matches the model pattern.

According to another aspect of the invention, an electronic engine control system for an internal combustion engine comprises means for monitoring preselected engine operating parameters including the operating states of one or more engine accessories and engine-driven components, means for sampling the engine operating parameters and producing and recording engine operation pattern data including first engine operating parameter-indicative data and a second time-indicative component, means for presetting a plurality of distinct model patterns, each including components corresponding to those in the engine operation pattern data and each representing a preselected engine operating condition, means for comparing the engine operation pattern data with each of the model patterns to judge if the engine operation pattern data approximately matches one of the model patterns, and means for performing control and fail-safe operations for the engine, normally solely on the basis of the engine operating parameters and on the basis of the engine operating parameters and the matching one of the model patterns when the engine operation pattern approximately matches one of the model patterns.

According to a further aspect of the invention, an electronic engine control system for an internal combustion engine comprises means for monitoring a preselected engine operating parameter and producing a first signal indicative thereof, means for periodically sampling the first signal and producing and recording engine operation pattern data including first engine operating parameter-indicative data and a second time-indicative component, means for presetting a model pattern including components corresponding t those in the engine operation pattern data and representing a preselected engine operating condition, means for presetting a reference pattern representative of a specific engine condition and including a proper subset of the information in the first signal, means for comparing the engine operation pattern data with the reference pattern and replacing the model pattern with the engine operation pattern data when the engine operation pattern data includes the reference pattern, means for comparing the engine operation pattern data with the model pattern to judge if the engine operation pattern data approximately matches the model pattern, and means for performing control and fail-safe operations for the engine, normally solely on the basis of the first signal, and on the basis of the first signal and the model pattern when the engine operation pattern approximately matches the model pattern.

According to a still further aspect of the invention, an electronic engine control system for an internal combustion engine comprises means for monitoring a preselected engine operating parameter and producing a first signal indicative thereof, means for sampling the first signal and producing and recording engine operation pattern data including first engine operating parameter-indicative data and a second time-indicative component, means for presetting a model pattern including components corresponding to those in the engine operation pattern data and representing a preselected engine operating condition, means for comparing the engine operation pattern data with the model pattern to judge if the engine operation pattern data approximately matches the model pattern, means for projecting probable immediate changes in engine operating conditions on the basis of the model pattern when the engine operation pattern data matches the model pattern to derive a projected engine operation pattern, and means for performing control and fail-safe operations for the engine, normally solely on the basis of the first signal, and on the basis of the first signal and the projected engine operation pattern when the engine operation pattern approximately matches the model pattern.

According to a still further aspect of the invention, an electronic engine control system for an internal combustion engine comprises means for monitoring a preselected engine operating parameter and producing a first signal indicative thereof, means for sampling the first signal and producing and recording engine operation pattern data including first engine operating parameter-indicative data and a second time-indicative component, means for presetting a model pattern including components corresponding to those in the engine operation pattern data and representing a preselected engine operating condition, means for means for presetting a reference pattern representative of a specific engine condition and including a proper subset of the information in the first signal, means for comparing the engine operation pattern data with the reference pattern and replacing the model pattern with the engine operation pattern data when the engine operation pattern data includes the reference pattern, means for comparing the engine operation pattern data with the model pattern to judge if the engine operation pattern data approximately matches the model pattern, means for projecting probable immediate changes in engine operating conditions on the basis of the model pattern when the engine operation pattern data matches the model pattern to derive a projected engine operation pattern, and means for performing control and fail-safe operations for the engine, normally solely on the basis of the first signal, and on the basis of the first signal and the projected engine operation pattern when the engine operation pattern approximately matches the model pattern.

According to a still further aspect of the invention, an electronic engine control system for an internal combustion engine comprises means for monitoring preselected engine operating parameters and producing a first signal indicative thereof, means for sampling the first signal and producing and recording engine operation pattern data including first engine operating parameter-indicative data and a second time-indicative component, means for presetting a plurality of distinct model patterns, each including components corresponding to those in the engine operation pattern data and each representing a preselected engine operating condition, means for presetting one or more reference patterns, each representative of a distinct specific engine condition and each including a proper subset of the information in the first signal, means for comparing the engine operation pattern data with each of the reference patterns and updating the model patterns in accordance with the engine operation pattern data when the engine operation pattern data includes one of the reference patterns, means for comparing the engine operation pattern data with each of the model patterns to judge if the engine operation pattern data approximately matches one of the model patterns, and means for performing control and fail-safe operations for the engine, normally solely on the basis of the first signal, and on the basis of the first signal and the matching one of the model patterns when the engine operation pattern approximately matches one of the model patterns.

According to a still further aspect of the invention, an electronic engine control system for an internal combustion engine comprises means for monitoring preselected engine operating parameters andproducing a first signal indicative thereof, means for sampling the first signal and producing and recording engine operation pattern data including first engine operating parameter-indicative data and a second time-indicative component, means for presetting a plurality of distinct model patterns, each including components corresponding to those in the engine operation pattern data and each representing a preselected engine operating condition, means for comparing the engine operation pattern data with each of the model patterns to judge if the engine operation pattern data approximately matches one of the model patterns, means for projecting probable immediate changes in engine operating conditions on the basis of the matching one of the model patterns when the engine operation pattern data matches one of the model patterns to derive a projected engine operation pattern, and means for performing control and fail-safe operations for the engine, normally solely on the basis of the first signal, and on the basis of the first signal and the projected engine operation pattern when the engine operation pattern approximately matches one of the model patterns.

According to a still further aspect of the invention, a method for controlling an automotive internal combustion engine comrises the steps of:

monitoring a preselected engine operating parameter and producing a first signal indicative thereof;

periodically sampling the first signal and producing and recording engine operation pattern data including first engine operating parameter-indicative data and a second time-indicative component;

presetting a model pattern including components corresponding to those in the engine operation pattern data and representing a preselected engine operating condition;

presetting a reference pattern representative of a specific engine condition and including a proper subset of the information in the first signal;

comparing the engine operation pattern data with the reference pattern and replacing the model pattern with the engine operation pattern data when the engine operation pattern data includes the reference pattern;

comparing the engine operation pattern data with the model pattern to judge if the engine operation pattern data approximately matches the model pattern; and performing control and fail-safe operations for the engine, normally solely on the basis of the first signal, and on the basis of the first signal and the model pattern when the engine operation pattern approximately matches the model pattern.

According to a still further aspect of the invention, a method for controlling an automotive internal combustion engine comprises the steps of:

monitoring a preselected engine operating parameter and producing a first signal indicative thereof;

periodically sampling the first signal and producing and recording engine operation pattern data including first engine operating parameter-indicative data and a second time-indicative component;

presetting a model pattern including components corresponding to those in the engine operation pattern data and representing a preselected engine operating condition;

comparing the engine operation pattern data with the model pattern to judge if the engine operation pattern data approximately matches the model pattern;

projecting probable immediate changes in engine operating conditions on the basis of the model pattern when the engine operation pattern data matches the model pattern to derive a projected engine operation pattern; and performing control and fail-safe operations for the engine, normally solely on the basis of the first signal, and on the basis of the first signal and the projected engine operation pattern when the engine operation pattern approximately matches the model pattern.

According to a still further aspect of the invention, a method for controlling an automotive internal combustion engine comprises the steps of:

monitoring a preselected engine operating parameter and producing a first signal indicative thereof;

periodically sampling the first signal and producing and recording engine operation pattern data including first engine operating parameter-indicative data and a second time-indicative component;

presetting a model pattern including components corresponding to those in the engine operation pattern data and representing a preselected engine operating condition;

presetting a reference pattern representative of a specific engine condition and including a proper subset of the information in the first signal;

comparing the engine operation pattern data with the reference pattern and replacing the model pattern with the engine operation pattern data when the engine operation pattern data includes the reference pattern;

comparing the engine operation pattern data with the model pattern to judge if the engine operation pattern data approximately matches the model pattern;

projecting probable immediate changes in engine operating conditions on the basis of the model pattern when the engine operation pattern data matches the model pattern to derive a projected engine operation pattern; and performing control and fail-safe operations for the engine, normally solely on the basis of the first signal, and on the basis of the first signal and the projected engine operation pattern when the engine operation pattern approximately matches the model pattern.

According to a still further aspect of the invention, a method for controlling an automotive internal combustion engine comprises the steps of:

monitoring preselected engine operating parameters and producing a first signal indicative thereof;

sampling the first signal and producing and recording engine operation pattern data including first engine operating parameter-indicative data and a second time-indicative component;

presetting a plurality of distinct model patterns, each including components corresponding to those in the engine operation pattern data and each representing a preselected engine operating condition;

presetting one or more reference patterns, each representative of a distinct specific engine condition and each including a proper subset of the information in the first signal;

comparing the engine operation pattern data with each of the reference patterns and updating the model patterns in accordance with the engine operation pattern data when the engine operation pattern data includes one of the reference patterns;

comparing the engine operation pattern data with each of the model patterns to judge if the engine operation pattern data approximately matches one of the model patterns; and performing control and fail-safe operations for the engine, normally solely on the basis of the first signal, and on the basis of the first signal and the matching one of the model patterns when the engine operation pattern approximately matches one of the model patterns.

According to a still further aspect of the invention, a method for controlling an automotive internal combustion engine comprises the steps of:

monitoring preselected engine operating parameters and producing a first signal indicative thereof;

sampling the first signal and producing and recording engine operation pattern data including first engine operating parameter-indicative data and a second time-indicative component;

presetting a plurality of distinct model patterns, each including components corresponding to those in the engine operation pattern data and each representing a preselected engine operating condition;

comparing the engine operation pattern data with each of the model patterns to judge if the engine operation pattern data approximately matches one of the model patterns;

projecting probable immediate changes in engine operating conditions on the basis of the matching one of the model patterns when the engine operation pattern data matches one of the model patterns to derive a projected engine operation pattern; and performing control and fail-safe operations for the engine, normally solely on the basis of the first signal, and on the basis of the first signal and the projected engine operation pattern when the engine operation pattern approximately matches one of the model patterns.

According to a still further aspect of the invention, a method for controlling an automotive internal combustion engine comprises the steps of:

monitoring preselected engine operating parameters and producing a first signal indicative thereof;

sampling the first signal and producing and recording engine operation pattern data including first engine operating parameter-indicative data and a second time-indicative component;

presetting a plurality of distinct model patterns, each including components corresponding to those in the engine operation pattern data and each representing a preselected engine operating condition;

presetting one or more reference patterns, each representative of a distinct specific engine condition and each including a proper subset of the information in the first signal;

comparing the engine operation pattern data with each of the reference patterns and replacing the model pattern with the engine operation pattern data when the engine operation pattern data includes one of the reference patterns;

comparing the engine operation pattern data with each of the model patterns to judge if the engine operation pattern data approximately matches one of the model patterns;

projecting probable immediate changes in engine operating conditions on the basis of the matching one of the model patterns when the engine operation pattern data matches one of the model patterns to derive a projected engine operation pattern; and performing control and fail-safe operations for the engine, normally solely on the basis of the first signal, and on the basis of the first signal and the projected engine operation pattern when the engine operation pattern approximately matches one of the model patterns.

According to a still further aspect of the invention, in an electronic control system for an internal combustion engine having an air induction system including an auxiliary air induction control means, a spark ignition system and a fuel supply system, the control system controlling an auxiliary air flow, a spark ignition, air/fuel ratio, fuel supply and other engine parameters, and the engine driving one or more vehicle components, a method for detecting occurrences of preselected engine operating conditions comprises the steps of:

monitoring preselected engine operation parameters including the operating states of one or more engine accessories and the engine-driven vehicle components;

sampling the engine operation parameters and producing and recording engine operation pattern data including a first parameter-indicative component and a second time-indicative component;

presetting various model patterns each representative of a preselected engine condition and each including components corresponding to those in the engine operation pattern data;

presetting various reference patterns, each representative of a preselected specific engine condition;

comparing the engine operation pattern data with each of the reference patterns to judge if the engine operation pattern data matches one of the reference patterns, and updating the model patterns in accordance with the engine operation pattern data when engine operation pattern data matches one of the reference patterns; and comparing the engine operation pattern data with each of the model patterns to judge if the engine operation pattern data matches one of the model patterns.

According to a still further aspect of the invention, in an electronic control system for an internal combustion engine having an air induction system including an auxiliary air induction control means, a spark ignition system and a fuel supply system, the control system controlling an auxiliary air flow, a spark ignition, air/fuel ratio, fuel supply and other engine parameters, and the engine driving one or more vehicle components, a method for projecting engine behavior immediately subsequent to preselected engine conditions comprises the steps of:

monitoring preselected engine operation parameters including the operating states of one or more engine accessories and the engine-driven vehicle components;

sampling the engine operation parameters and producing and recording engine operation pattern data including a first parameter-indicative component and a second time-indicative component;

presetting various model patterns, each representative of specific engine condition and including the component corresponding to that in the engine operation parameter data;

presetting various reference patterns, each representative of a preselected engine condition;

comparing the engine operation pattern data with each of the reference patterns to judge if the engine operation pattern data matches one of the reference patterns, and updating the model patterns in accordance with the engine operation pattern data when the engine operation pattern data matches one of the reference patterns;

comparing the engine operation pattern data with each of the model patterns to judge if the engine operation pattern data matches one of the model patterns; and projecting probable engine behavior in the immediate future on the basis of the model pattern matching the engine operation pattern data.

BRIEF DESCRIPTION OF THE DRAWINGS

The present invention will be understood more fully from the detailed description given below and from the accompanying drawings of the preferred embodiment of the invention, which, however, should not be taken to limit the invention to the specific embodiments but are for explanation and understanding only.

In the drawings.

DESCRIPTION OF THE PREFERRED EMBODIMENT

Figure 1:
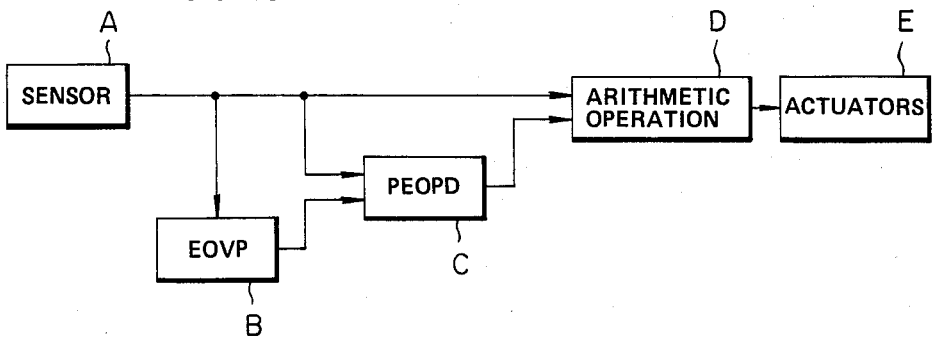
FIGS. 1 to 6 are schematic illustrations of various arrangements of the preferred embodiment of an engine control system in accordance with the present invention, in which each block represents a set of related operations performed by a microprocessor serving as a controller in the engine control system.

Referring now to the drawings, FIGS. 1 to 6 illustrate various arrangements of operations for recording engine operation patterns and projecting probable engine operation subsequent to specific engine operation conditions. Though the specific embodiments will be illustrated and described in detail later, it should be noted that any of the arrangements illustrated in FIGS. 1 to 6 are applicable to the engine control system described below.

In the first arrangement shown in FIG. 1, a sensor A which is representative of one or more sensors for detecting engine operation parameters such as engine speed, air induction amount, throttle valve position, and oxygen concentration in the exhaust gas. The sensor A may also include sensors for detecting operating conditions of vehicle components influencing engine operation, such as transmission gear position and the operating state of an air conditioner. The sensor A is connected to a engine operation variation pattern deriving block B in a controller 1000. The block B receives the output from the sensor and detects instantaneous engine operating conditions. The block B checks the detected instantaneous engine operating conditions for the occurrence of specific preselected engine operating conditions, such as engine acceleration, deceleration and/or stalling. In response to any of the specific engine operating conditions, a preset model pattern of subsequent variation of engine operating parameters which will be hereafter referred to as "engine operation variation pattern" or "EOVP", is output. The output of the sensor A and the EOVP output of the block B are both fed to a block C. In the block C, a probable pattern of subsequent engine operation is derived on the basis of the sensor output and the EOVP output. The data derived in the block C will be hereafter referred to as "projected engine operation pattern data" or "PEOPD". The PEOPD output of the block C is fed to an arithmetic operation block D to which the sensor output also supplied. In the block D, engine control signal driving actuators E to control fuel injection, air induction rate, air/fuel ratio, spark ignition and so forth are normally derived solely on the basis of the sensor output. When the specific engine operating condition is detected and thus the PEOPD is output by the block C, a modification or correction of engine control signals is performed according to a predetermined schedule for optimizing engine performance and preventing undesirable engine behavior. The block D may also be programmed to perform self-monitoring or checking operations for each element in the control system. Also, if necessary, the block D can control one or more auxiliary vehicle components, such as an air conditioner, to ensure good engine performance and prevent undesirable engine behavior.

In the arrangement as set forth above, the block B may continuously monitor variations in the engine operating parameters and record or update the EOVP whenever the specific engine operating conditions are detected. For example, whenever the engine stalls, the block D records the variation pattern of the engine operation immediately prior to and resulting in engine stall as the new engine stall-indicative EOVP data.

Figure 2:
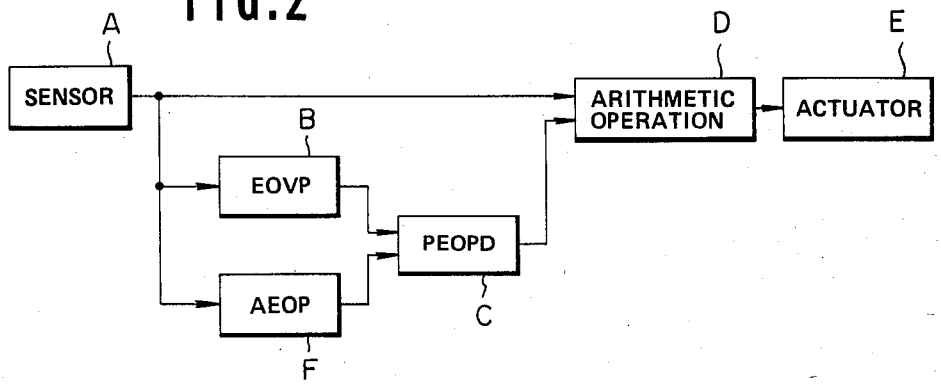

The second arrangement shown in FIG. 2 includes the sensor A and the block B operating substantially the same as in the first arrangement. A block F is added and connected to the sensor A to receive the sensor output. In the block F, engine operating parameters indicated by the sensor outputs are sampled at given intervals. An actual engine operation variation pattern is derived by the block F on the basis of the sampled engine operating parameters. Hereafter, the data derived by the block F will be referred to as "actual engine operation pattern data" or "AEOP data". AEOP data and the EOVP data from the block B are fed to a block C. The two data sets are processed to derive the PEOPD in the block C. The PEOPD derived in the block C is fed to the block D to cause the latter to modify or correct the control signals as set forth above.

Figure 3:
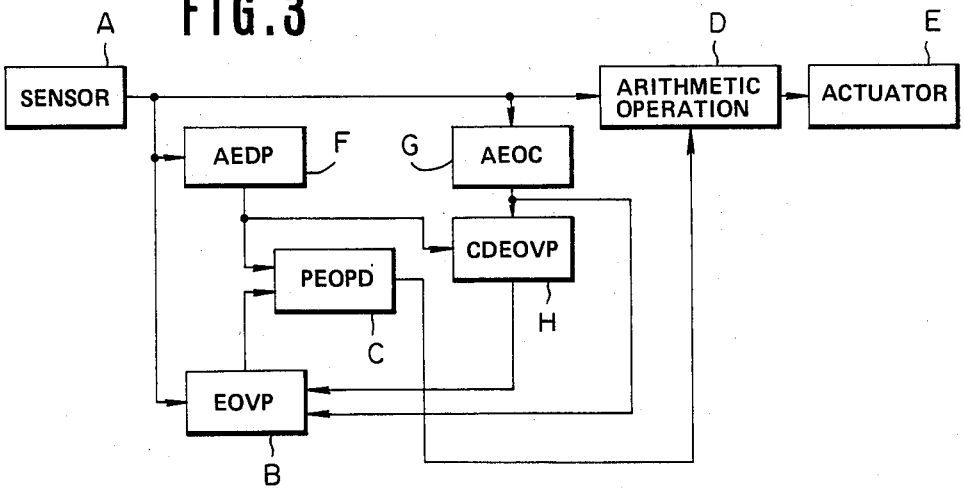

In the third arrangement shown in FIG. 3, a block G is provided to detect actual engine operating conditions on the basis of the sensor signal outputs from the sensor A. The block G outputs a signal indicative of detected actual engine operating conditions, which signal will be hereafter referred to as "actual engine operating condition data" or "AEOC data". A block H responds to AEOC data indicative of a preselected specific engine operating condition by recording AEOP data from the block F to set and/or update a variation pattern of engine operation associated with the specific conditions. The data stored in the block H will be hereafter referred to as "condition-dependent engine operation variation pattern data" or "CDEOVP data". AEOC data and CDOVP data are fed to block B which derives the EOVP data based on the AEOC data, CDEOVP data and sensor output. EOVP data and AEOP data from the block F are fed to the block C in which PEOPD are derived. As in the first and second arrangements, the block D derives the control signals and modifies the control signals according to the AEOPD.

The fourth and fifth arrangements differ from the first three in that only current engine control signals are adjusted, rather than adjusting the control signals over a given period according to a schedule. In the fourth arrangement shown in FIG. 4, a block J is connected for input from the blocks 11 and 12 and derives the instantaneous engine condition from among the CDEOVP data in the block 11 by reference to the AEOP data from the block 12. The block D controls the engine as set forth above while taking the instantaneous engine condition, which will be referred to as "instantaneous engine condition" or "IEC data", into account.

The IEC data may include information about the operating states of the above-mentioned engine operation-influencing vehicle components such as the transmission and the air conditioner. The IEC may be indicative of the transmission gear position, the ON/OFF state of an air conditioner switch or so forth.

The CDEOVP may be present with various empirical data in the factory.

Figure 5:
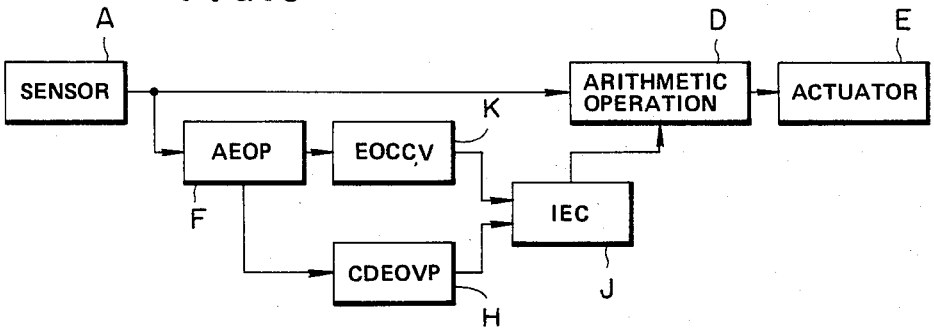

In the fith arrangement shown in FIG. 5, a block K is inserted between the blocks F and J. The block K notes actual engine condition representative values including average values, upper and lower peak values and intervals between the peaks. Combinations of such values characterize corresponding engine operating conditions and will be hereafter referred to as "engine operating condition characterizing values" or "EOCCV data". In this arrangement, the IEC data deriving block J uses the EOCCV data instead of the AEOP data from the block F. In order to be compatible with the EOCCV data, the block H in this arrangement outputs a combination of values characterizing preselected specific engine operating conditions.

Figure 4:
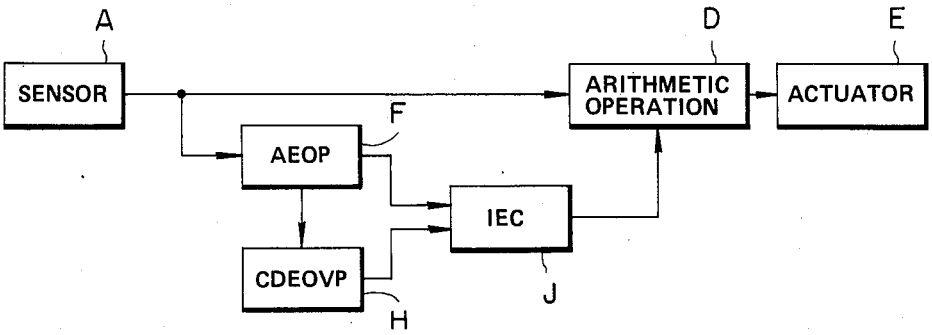
Figure 6:
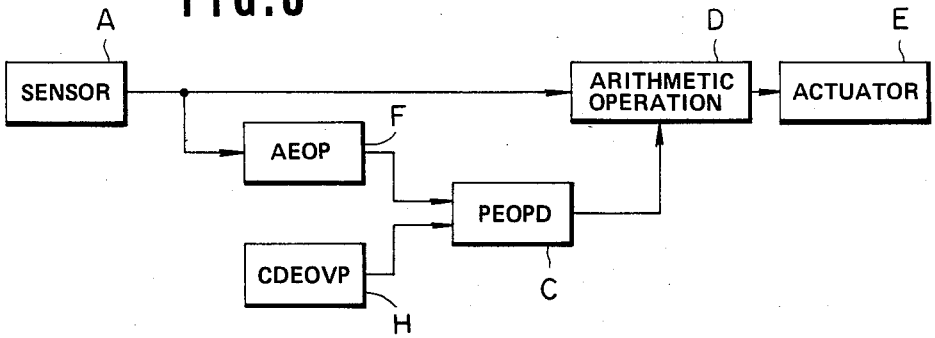

In sixth arrangement of FIG. 6, the IEC data deriving block J of FIG. 4 is replaced by the PEOPD deriving block C of FIGS. 1–3. In this arrangement, the PEOPD is derived on the basis of AEOP data from the block F and the CDEOVP data from the block H.

Figure 7A:
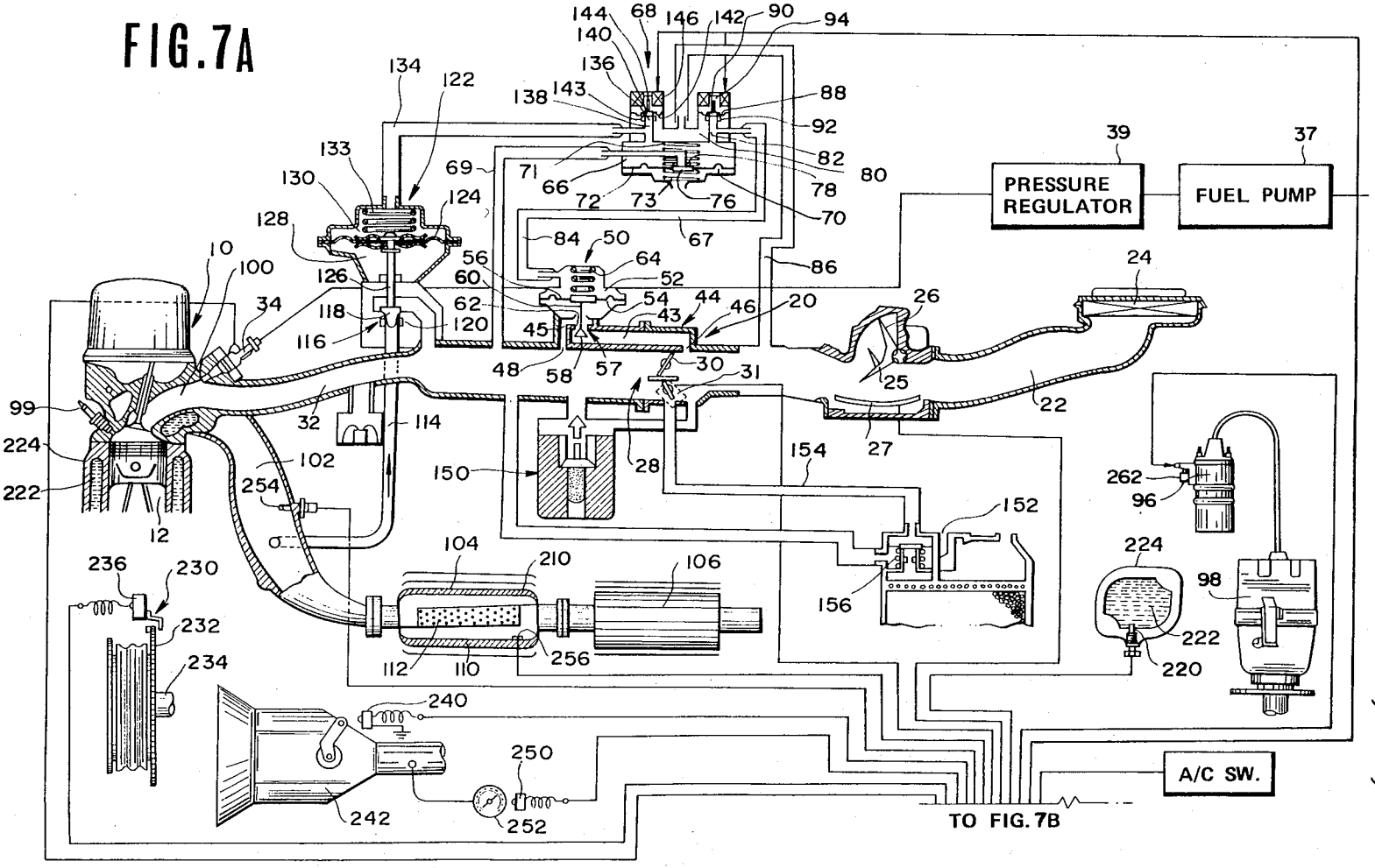
FIGS. 7A and 7B are diagrams of the overall structure of the preferred embodiment of an electronic automotive engine control system according to the present invention.
Figure 7B:
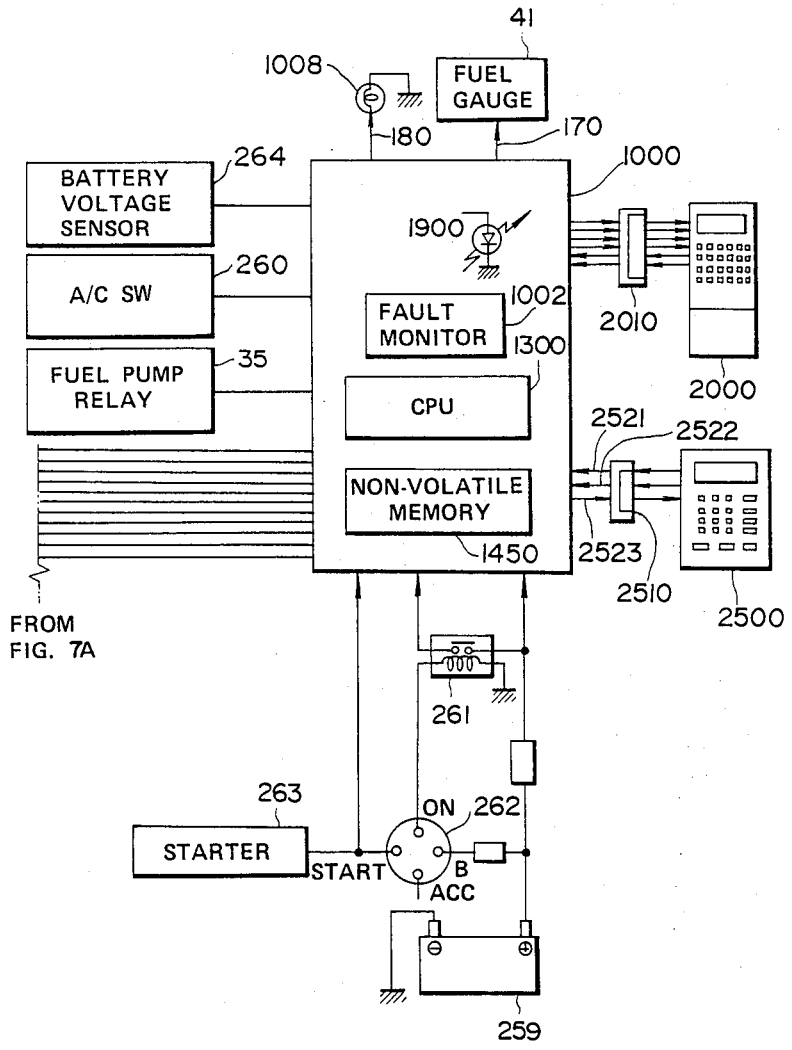
Figure 8:
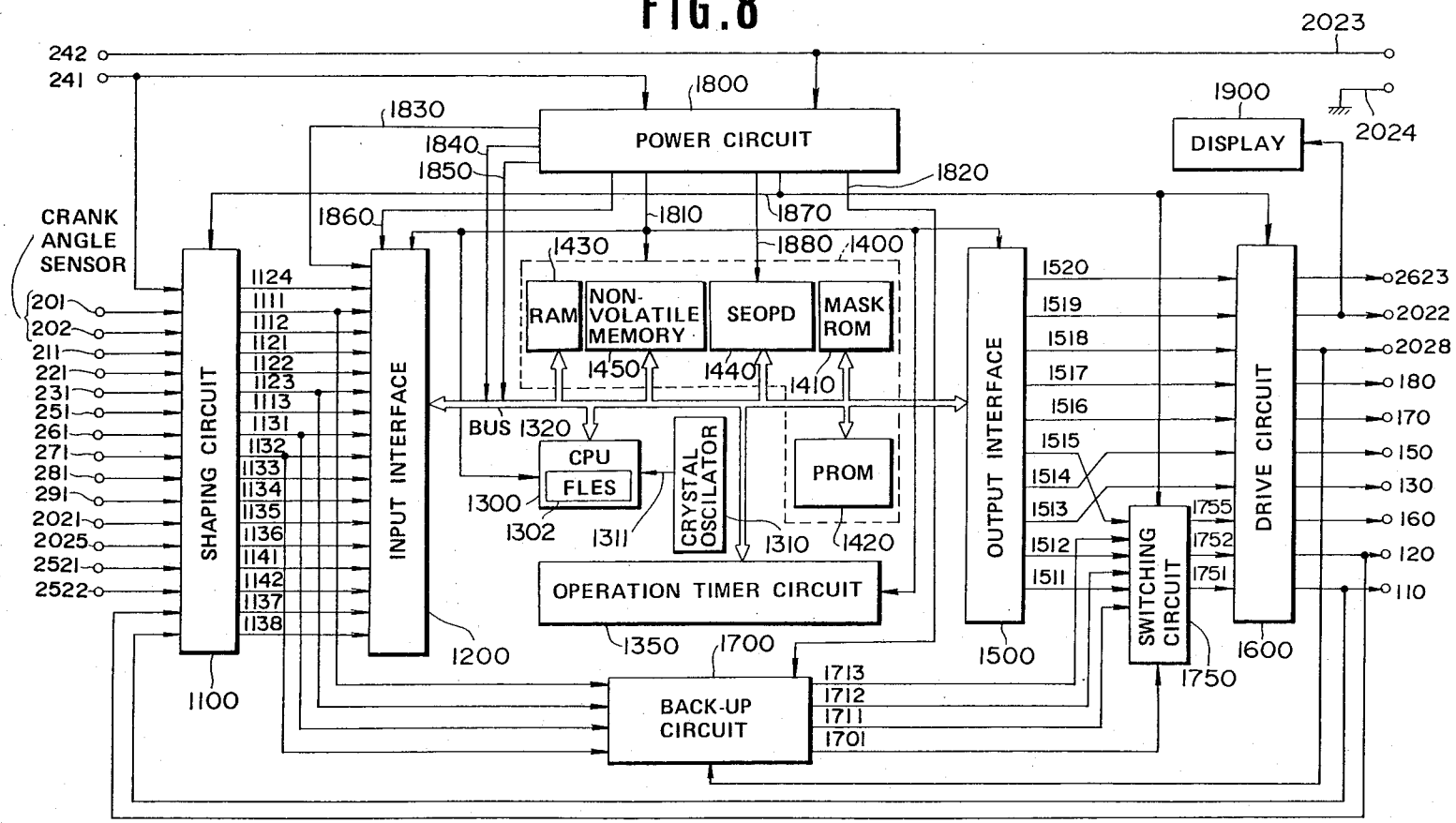
FIG. 8 is a block diagram of a controller in the preferred embodiment of the engine control system of FIGS. 7A and 7B.

FIGS. 7A, 7B and 8 illustrate the preferred embodiment of the engine control system in accordance with the present invention. The controller 1000 comprises a microprocessor and is associated with another microprocessor 2500 which serves as a vehicle information system. The engine control system 1000 includes various sensors and detectors such as an engine speed sensor, an air flow meter, and various temperature sensors, for providing control parameters, a control unit and actuators for controlling various engine operations such as fuel metering, idle air flow, and spark ignition timing. The engine control system further includes a fault monitor for detecting faults in the control system. The fault monitor checks the operation of the control unit and the inputs from the sensors. The results of the check operation in the fault monitor are conducted to a non-volatile memory 1450 which is associated with the engine control system 1000. The check operation results are also fed to a display 1900 for control system fault indication through a data line 2022. On the other hand, the vehicle information system 2500 in the shown embodiment is adapted to compute travelling distance, travelling time, average vehicle speed and so on in order to display information related to the current vehicle trip. The vehicle information system 2500 is associated with an external input unit 2540 such as a keyboard and a display 2520 for information display. The vehicle information system 2500 is further associated with a non-volatile memory 2530 for storing the computed results.

In the shown embodiment, the non-volatile memories may be of Metal-Nitride-Oxide-Silicon (MNOS), Erasable Programable ROM (EPROM) or CMOS technologies. In addition, the display can comprise various elements for indicating or warning when the system or sensors malfunction.

The engine control system 1000 and the vehicle information system 2500 are connected to each other via a data transmission line 2600. The vehicle information system 2500 produces a read command when a read request is inputted to the input unit. The read command is fed to the engine control system through the data transmission line 2600 to read the data out of the non-volatile memory 1450. The read request is inputted to the input unit when the display 1900 indicates an error in the engine control system 1000.

The data from the non-volatile memory 1450 is transferred to the vehicle information system 2500 via the fault monitor in the engine control system 1000 and the data transmission line 2600. The vehicle information system 2500 distinguishes which sensor or element of the control unit in the engine control system is malfunctioning. Based on the detection of the faulty element or sensor, the vehicle information system 2500 feeds a fault display signal to the display 2520. Therefore, in response to the fault display signal and in accordance with the fault display signal value, the display 2520 indicates the faulty sensor or element and the degree of error thereof.

It should be appreciated that the fault monitor outputs data in response to the read command and holds the check program results until the next read command is received. In addition, the fault monitor connected in this manner to the vehicle information system according to the present invention is applicable not only to the foregoing engine control system but also to electronic control systems for automatic power transmission or for anti-skid control and so forth.

FIG. 7A illustrates the electronic engine control system, so-called Electronic Concentrated Control System (ECCS) for a 6-cylinder reciprocating engine known as a Datsun L-type engine. In the shown control system, fuel injection, spark ignition timing, exhaust gas recirculation rate and engine idling speed are all controlled. Fuel pressure is controlled by controlling fuel pump operation.

In FIG. 7A, each of the engine cylinders 12 of an internal combustion engine 10 communicates with an air induction system generally referred to by reference numeral 20. The air induction system 20 comprises an air intake duct 22 with an air cleaner 24 for cleaning atmospheric air, an air flow meter 26 provided downstream of the air intake duct 22 to measure the amount of intake air flowing therethrough, a throttle chamber 28 in which is disposed a throttle valve 30 cooperatively coupled with an accelerator pedal (not shown) so as to adjust the flow of intake air, and an intake manifold 32. The air flow meter 26 comprises a flap member 25 and a rheostat 27. The flap member 25 is pivotably supported in the air intake passage 20 so that its angular position varies according to the air flow rate. Specifically, the flap member 25 rotates clockwise in FIG. 7A as the air flow rate increases. The rheostat 27 opposes the flap member 25 and generates an analog signal with a voltage level proportional to the intake air flow rate. The rheostat 27 is connected to an electrical power source and its resistance value is variable in correspondence to variation of the angular position of the flap member 25 depending in turn on variation of the air flow rate.

Though a flap-type air flow meter has been specifically illustrated, this can be replaced with any equivalent sensor, such as a hot wire sensor or a Karman vortex sensor, for example.

A throttle angle sensor 31 is associated with the throttle valve 30. The throttle angle sensor 31 comprises a full-throttle switch which is closed when the throttle valve is open beyond a given open angle and an idle switch which is closed when the throttle valve is open less than a minimum value.

A throttle switch of this type is illustrated in the European Patent First Publication No. 0058826, published on Sept. 1, 1982. The contents of this European First Publication is hereby incorporated by reference for the sake of complete disclosure.

Fuel injection through the fuel injectors 34 is controlled by an electromagnetic actuator (not shown) incorporated in each fuel injector. The actuator is electrically operated by the fuel injection control system which determines fuel injection quantity, fuel injection timing and so on in correspondence to engine operating conditions determined on the basis of measured engine operation parameters such as engine load, engine speed and so on. The fuel injector 34 is connected to a fuel pump 37 through a fuel feed line including a pressure regulator 39. The fuel pump 37 is controlled by means of a fuel pump relay 35. If necessary, fuel pressure may be controlled in the manner described in the co-pending U.S. patent application Ser. No. 355,157, filed on Mar. 5, 1982, which is a continuation application of U.S. patent application Ser. No. 101,548 now abandoned, which corresponds to German Patent First Publication (DE-OS) No. 29 49 988.5, published on July 31, 1980. The contents of the above-identified application is hereby incorporated by reference for the sake of complete disclosure. In the alternative, the fuel pressure may be controlled in the manner described in the co-pending U.S. patent application filed on Sept. 28, 1984, and entitled CONTROL SYSTEM FOR FUEL PUMP FOR INTERNAL COMBUSTION ENGINE, the Japanese counterpart of which is now pending under Japanese Utility Model Application No. 58-52096. The contents of this co-pending application is also hereby incorporated by reference for the sake of disclosure.

It should be noted that, although the fuel injector 34 is disposed in the intake manifold 32 in the shown embodiment, it is possible to locate it in the combustion chamber 12 in a per se well-known manner.

An idle air or an auxiliary air intake passage 44 is provided in the air induction system 20. One end 46 of the idle air intake passage 44 opens between the air flow meter 26 and the throttle valve 30 and the other end 48 opens downstream of the throttle valve 30, near the intake manifold 32. Thus the idle air intake passage 44 bypasses the throttle valve 30 and connects the upstream side of the throttle valve 30 to the intake manifold 32. An idle air control valve, generally referred to by reference numeral 50, is provided in the idle air intake passage 44. The idle air control valve 50 generally comprises two chambers 52 and 54 separated by a diaphragm 56. The idle air control valve 50 includes a poppet valve 58 disposed within a port 57 so as to be movable between two positions, one allowing communication between the upstream and downstream sides 43 and 45 of the idle air intake passage 44 and the other preventing communication therebetween. The idle air intake passage 44 is thus separated by the idle air control valve 50 into two regimes 43 and 45 respectively located upstream and downstream of the port 57 of the idle air control valve. The poppet valve 58 has a stem 60 which is secured to the diaphragm 56 so as to move therewith. The diaphragm 56 is biased downwards in the drawing, so as to displace the poppet valve 58 from a valve seat 62, by a helical compression coil spring 64 disposed within the chamber 52 of the valve means 50. Thereby, the idle air control valve 50 is normally opened, and normally connects the regimes 43 and 45 of the idle air intake passage 44 to one another, via its valve port 57.

The chamber 54 of the idle control valve 50 is open to the atmosphere. On the other hand, the chamber 52 of the idle air control valve 50 communicates through a vacuum passage 67 with a pressure regulating valve 68 serving as the control vacuum source. The pressure regulating valve 68 is separated generally into two chambers 66 and 70 by a diaphragm 72. The chamber 66 of the pressure regulating valve 68 also communicates with the downstream side of the throttle valve 30 through the vacuum passage 69 so as to reflect the level of the intake vacuum. The chamber 70 is open to the atmosphere in a per se well-known manner. To the diaphragm 72 is secured a valve member 76 which opposes a valve seat 78 provided at the end of the passage 69. The chambers 66 and 70 receive helical compression springs 71 and 73 respectively. The position at which the springs 71 and 73 balance each other is referred to as the neutral position of the diaphragm 72. It will be noted that the chamber 66 can also be connected to an exhaust gas recirculation (EGR) rate control valve 116 which recirculates a fraction of the exhaust gas from an exhaust gas passage and exhaust gas recirculation passage to the intake manifold 32.

The diaphragm 72 moves upwards or downwards according to changes in the balance between the vacuum in the chamber 66 and the atmospheric pressure introduced into the chamber 70. This movement of the diaphragm 72, moves the valve member 76 toward or away from the valve seat 78.

Another chamber 80 is also defined in the control valve 68, which chamber 80 communicates with the chamber 66 through a passage 82. The passage 82 is connected with the chamber 52 of the idle air control valve 50 through a control vacuum passage 84. On the other hand, the chamber 80 also communicates with the air intake passage 20 upstream of the throttle valve 30 through a passage 86 so as to be exposed to atmosphere. The chamber 80 is partitioned by a diaphragm 88 to which a magnetic valve member 90 is secured. The magnetic valve member 90 opposes a valve seat 92 formed at the end of the passage 82. Also, the magnetic valve member 90 opposes an electromagnetic actuator 94, the duty cycle of which is controlled by a control pulse signal generated by a controller 100. Depending on the amount of atmospheric pressure introduced into the passage 82 from the chamber 80, which is determined by the duty cycle of the electromagnetic actuator 94 which in turn is determined by the duty cycle of the control pulse signal, the control vacuum for controlling the opening degree of the valve member 58 of the idle air control valve 50 is regulated and supplied via the control vacuum passage 67.

Spark ignition plugs 99 are installed in each of the engine cylinders 12 to perform spark ignition at a controlled timing. Each ignition plug 99 is connected to a distributor 98 which receives high voltage power from an ignition coil 96. The distributor 98 is controlled by a spark advancer which advances or retards the spark ignition timing depending on engine operating conditions.

An exhaust system for the engine exhaust gas comprises an exhaust manifold 100, an exhaust duct 102, an exhaust gas purifier 104, a muffler 106 and a exhaust vent 108. The exhaust manifold 100 opens toward the engine cylinders to draw engine exhaust gas therefrom. The exhaust duct 102 communicates with the exhaust manifold 100 and includes the exhaust gas purifier 104 and the muffler 106. In the shown embodiment, the exhaust gas purifier 104 comprises a purifier housing 110 and a three-way catalytic converter 112 disposed within the purifier housing 110. The three-way catalytic converter 112 oxidizes monoxide carbon CO and hydrocarbons HC and reduces oxides of nitrogen $NO_x$.

An exhaust gas recirculation passage 114, which will be referred to hereafter as the EGR passage, is connected to the exhaust duct 102 upstream of the exhaust gas purifier 104. The EGR passage 114 communicates with the intake manifold 32 via an exhaust gas recirculation rate control valve 116 which will be referred as the EGR control valve. The EGR control valve 116 generally comprises a valve member 118 with a valve seat 120 form in the end of the EGR passage 114 adjacent the intake manifold 32. The valve member 118 is associated with a vacuum actuator 122 and is cooperatively connected to a diaphragm 124 of the vacuum actuator 122 via a steam 126. The diaphragm 124 divides the interior of the vacuum actuator 122 into two chambers 128 and 130. The chamber 128 communicates with the EGR passage 114 via a passage 132 and the chamber 130 communicates with the regulating valve 68 via a control vacuum passage 134. A set spring 133 for biassing the diaphragm 124 is disposed within chamber 130. The control vacuum passage 134 is connected to a passage 136 connecting the vacuum chamber 66 to a chamber 138. One end of the passage 136 faces a valve member 140 secured to a diaphragm 142. A valve seat 143 is formed in the end of passage 136 to allow the valve member 140 to selectably seal passage 136. The valve member 140 has a stem 144 projecting into an electromagnetic actuator 146.

The duty cycle of the electromagnetic actuator 146 is controlled to move the valve member 140 with respect to the valve seat 143 in response to a control signal generated by a controller to be described later. According to the instantaneous position of the valve member 140, intake air is admitted to the passage 136 via the passage 86 at a controlled rate. The intake air admitted into the passage 136 is mixed with the intake vacuum admitted from intake passage 20 downstream of the throttle valve 30 via the vacuum induction passage 69 into the vacuum chamber 66, so as to produce the control vacuum. The control vacuum thus produced is conducted to the chamber 130 of the actuator 122 via the control vacuum passage 134 to control the operation of the EGR control valve 116. Thereby, the exhaust gas is admitted into the intake manifold at a controlled rate.

An air regulator 150 is provided near the throttle chamber 28 for regulating the intake air flowing through the throttle chamber. Also, a carbon canister 152 is provided. The carbon canister 152 retains hydrocarbon vapor until the canister is purged by air via the purge line 154 to the intake manifold when the engine is running. When the engine is idling, the purge control valve 156 is closed. Only a small amount of purge air flows into the intake manifold through the constant purge orifice. As the engine speed increases, and the ported vacuum becomes stranger, the purge control valve 156 opens and the vapor is drawn into the intake manifold through both the fixed orifice and the constant purge orifice. The carbon canister 152 can trap hydrocarbons due to the chemical action of the charcoal therein.

As shown in FIG. 7B, the controller 1000 generally comprises a microcomputer and controls a fuel injection system, a spark ignition system, an EGR system and engine idling speed. The controller 1000 is connected to an engine coolant temperature sensor 220. The engine coolant temperature sensor 200 is usually disposed within a coolant chamber 222 in an engine cylinder block 224 in order to measure the engine coolant temperature. The engine coolant temperature sensor 220 produces an engine coolant temperature signal $T_w$ indicative of the measured engine coolant temperature. The engine coolant temperature signal $T_w$ is an analog signal with a voltage value proportional to the determined engine coolant temperature and is converted into a digital signal by a shaping circuit 1100 to adapt it for use by the digital controller 1001.

Generally speaking, the engine coolant temperature sensor 220 comprises a thermistor fitted onto a thermostat housing 226 provided in the coolant circulation circuit.

A crank angle sensor 230 is also connected to the controller 200. The crank angle sensor 230 generally comprises a signal disc 232 secured to a crank shaft 234 for rotation therewith, and an electromagnetic pick-up 236. The crank angle sensor 230 produces a crank reference angle signal and a crank position angle signal. As is well known, the crank reference angle signal is produced when the engine piston reaches the top dead center and the crank position angle signal is produced per a given unit of crank rotation, e.g., per 1 degree of crank rotation.

If necessary a special type of crank angle sensor such as is disclosed in the co-pending U.S. patent application Ser. No. 445,552, filed on Nov. 30, 1982 can be used. The contents of the above-identified co-pending U.S. patent application are hereby incorporated for the sake of disclosure. Also, if necessary, a timing calculation system described in the European Patent First Publication No. 00 85 909, published on Aug. 17, 1983 and the back-up system described in the European Patent First Publication No. 00 81 648, are applicable to the shown engine control system. The contents of these Europan Patent First Publications are hereby incorporated by reference for the sake of disclosure.

A transmission neutral switch 240 is connected to the controller 200. The transmission neutral switch 240 is secured to the transmission 242 to detect the neutral position thereof and produces a neutral signal when the transmission is in the neutral position.

Also, a vehicle speed sensor 250 is connected to the controller via a vehicle speed counter 204. The vehicle speed sensor 250 is located near a vehicle speed indicator 252 and produces a pulse train serving as a vehicle speed signal, the frequency of which is proportional to the vehicle speed.

An exhaust gas temperature sensor 256 is installed in the exhaust gas purifier housing 210. The exhaust gas temperature sensor 256 monitors the exhaust gas temperature and produces an analog signal as an exhaust gas temperature signal, the voltage of which is proportional to the exhaust gas temperature. The exhaust gas temperature signal is supplied to the controller 200 via the multiplexer 205 and the analog-digital converter 206 in which the exhaust gas temperature signal is converted into a digital signal suitable for use by the microcomputer 207. The digital signal indicative of the exhaust gas temperature has a frequency corresponding to the voltage of the exhaust gas temperature signal.

In addition, an exhaust gas sensor 254 such as an oxygen sensor, hereafter referred to simply as the $O_2$ sensor 254, is installed in the exhaust duct 102 upstream of the opening of the EGR passage 114. The $O_2$ sensor 254 monitor the concentration of oxygen in the exhaust gas. The output of the $O_2$ sensor goes high when the determined oxygen concentration exceeds a 1:1 ratio with other exhaust gas components and goes low when the oxygen concentration is less than a 1:1 ratio. The output of the $O_2$ sensor is inputted to the microcomputer 207 via the multiplexer 205 and the analog-digital converter 206 as a λ-signal.

In addition, the air flow meter 26 is connected to the controller 200. The rheostat 27 of the air flow meter 26 outputs an analog signal with a voltage proportional to the intake air flow rate. The throttle angle sensor 31 is also connected to the microcomputer 207 to supply the outputs of the full-throttle switch and the idle switch.

As shown in block form in FIG. 7B, the microcomputer 207 is also connected with an air-conditioner switch 260, a starter switch 262, an ignition switch 263 and a battery voltage sensor 264. The air-conditioner switch 260 is closed when the air-conditioner is operating. Also, the starter switch 262 is closed when the starter is operating. The battery voltage sensor 264 monitors the vehicle battery voltage and produces an analog signal with a voltage proportional to the determined battery voltage. The battery voltage signal is fed to the microcomputer 207 via the multiplexer 205 and the analog-digital converter 206.

In the shown embodiment, the controller 200 controls the fuel injection amount and timing, the spark ignition timing, the EGR rate and the engine idling speed.

The $O_2$ sensor signal from the $O_2$ sensor 254 is used to control the fuel injection quantity under stable engine conditions as determined with reference to the engine speed from the engine speed counter 203, the throttle valve angle position detected by the throttle angle sensor 31, the vehicle speed from the vehicle speed counter 204 and so on. Under stable engine conditions, the fuel injection quantity is feedback controlled on the basis of the $O_2$ sensor signal so that the air/fuel ratio can be controlled to the stoichiometric value. This method of fuel injection control is called λ-control. If the engine is running under unstable conditions, the fuel injection quantity is generally determined on the basis of engine speed and intake air flow rate, the latter of which can be replaced by intake vacuum pressure downstream of the throttle valve. Under unstable engine conditions, the basic fuel injection quantity determined on the basis of engine speed and air flow rate is corrected according to other parameters such as air-conditioner switch position, transmission gear position, engine coolant temperature and so on.

The spark ignition timing is generally controlled on the basis of engine speed, air flow rate, engine coolant temperature and so on, which effect to varying degrees the advance and retard of the spark advance.

The EGR control is effected on the basis of engine speed, engine coolant temperature, ignition switch position and battery voltage. The recirculation rate of the exhaust gas is derived from the engine speed and a basic fuel injection quantity determined according to engine speed and engine load. The duty cycle of the EGR control valve is thus controlled in accordance with the determined recirculation rate.

The idle engine speed is controlled predominantly on the basis of engine coolant temperature and engine load condition. Under relatively cold engine conditions, the engine speed is maintained at a predetermined value, determined with reference to the engine coolant temperature, resulting in fast idle operation. In the normal temperature range, the engine speed is feedback-controlled on the basis of the difference between the actual engine speed and a reference engine speed determined on the basis of engine temperature, engine load condition and other parameters.

As shown in FIGS. 7A and 7B, the controller 1000 also includes a fault monitor 1002. In practice, the fault monitor 1002 is a program stored in a memory 1004 and executed in a central processing unit (CPU) 1006. The controller 1000 is connectable with an external check unit 2000 via a check connector 2010. The check unit 2000 signals the controller 1000 to make the fault monitor operative in order to check a series of check items identified by inputs. This external check unit 2000 has been described in Japanese Patent Prepublication No. 56-141534 published Nov. 5, 1981. The contents of this prepublication is hereby incorporated by reference. The controller 1000 is also connected to the vehicle information system 2500 via a connector 2510.

The fault monitor 1002 of the controller 1000 is connected to a fault indicator 1008 via line 180. The fault monitor 1002 produces a fault signal $S_f$ when an error occurs in any one of the check items. The fault indicator turns on in response to the fault signal $S_f$ to indicate malfunction of the engine control system. The fault monitor 1002 is associated with the non-volatile memory 1450 as set forth previously. Upon execution of the check program, check data from a series of check items are stored in the non-volatile memory 1450. When the fault indicator 1008 is turned on, the input unit 2540 of the vehicle information system generates and outputs the read request command to the engine control system in order to read the check data out of the non-volatile memory 1450. On the basis of the retrieved check data, the vehicle information system 2500 feeds the fault display signal to the display 2520 in order to identify the specific faulty segment and error condition on the display.

FIG. 8 shows the controller 1000 of FIG. 7 in greater detail. The crank angle sensor 230, the vehicle speed sensor 250, the throttle angle sensor 31, the air-conditioner switch 260, the transmission neutral switch 240, the starter switch 262, the ignition switch 263, the air flow meter 26, the engine coolant temperature sensor 220, the exhaust gas sensor 254, the exhaust gas temperature sensor 256, the battery voltage sensor 264 are all connected to an input interface 1200 of the digital controller 1000 via a signal shaping circuit 1100. The shaping circuit 1100 eliminates noise in the sensor signals, absorbs surge voltages and shapes respective sensor signals. The interface 1200 includes a crank reference signal counter, an engine speed counter, a vehicle speed counter and analog-to-digital (A/D) converter with a multiplexer. The crank reference signal counter and the engine speed counter are both connected to the crank angle sensor 230 to receive therefrom the crank reference angle signal and the crank position angle signal respectively. The vehicle speed counter is adapted to count the pulses of the vehicle speed sensor signal to produce a digital value representative of the vehicle speed. The air flow meter 26, the engine coolant temperature sensor 220, the exhaust gas sensor 254, the exhaust gas temperature sensor 256, the battery voltage sensor 264 all produce analog signals and are connected to the analog-to-digital converter so that the corresponding analog signals can be converted to corresponding digital signals suitable for use in the digital controller 1000.

The interface 1200 further includes a clock generator for controlling interface operations on a time-sharing basis, and a register for temporarily storing the inputted sensor signal values.

As usual, the digital controller 1000 includes a central processing unit (CPU) 1300, a memory unit 1400 including random access memory (RAM) 1430 and programmable read-only memory (PROM) 1420, and an output interface 1500. As shown in FIG. 8, the memory unit 1400 also includes non-volatile memory 1450, a holding memory 1440 and a masked ROM 1410. The CPU 1300 is connected to a clock generator including a crystal oscillator 1310 for controlling CPU operations on an incremental time basis. The CPU 1300 is also connected to each segment of the memory unit 1400, the register of the interface 1200 and the output interface 1500 via bus line 1320. The CPU 1300 executes programs stored in the masked ROM 1410 and the PROM 1420 in conjunction with input data read out from the register in the interface 1200. The results of execution of the programs are transferred to the output interface 1500 through the bus line 1320 for output.

As set forth previously, the masked ROM 1410 holds predetermined programs and initial program data. The PROM 1420 also stores programs and program data which are chosen initially depending upon the model of the vehicle and the type of engine. The RAM 1430 can renewably store data during execution of the programs and hold the results to be outputted. The contents of the RAM 1430 are cleared when power is turned off via the ignition switch. As stated previously, the non-volatile memory 1450 also stores data for the fault monitor. The contents of the non-volatile memory 1450 are maintained even when the ignition switch is turned off.

The controller 1000 also includes an operation timer circuit 1350 for controlling arithmetic operation, execution of programs and initiation of interrupts of the CPU. The operation timer 1350 includes a multiplier 1351 for high-speed arithmetic operations, an interval timer for producing interrupt requests and a free-run counter which keeps track of the transition intervals between one engine control program and another in the CPU 1300 and the starting period of execution mode, so as to control the sequential execution of a plurality of control programs.

The output interface 1500 includes an output register which temporarily stores the output data and a signal generator which produces control signals either with duty cycles defining the results of execution of the control programs in the CPU 1300 or with on/off switching characteristics.

The signal generator of the output interface is connected to a drive circuit 1600. The drive circuit 1600 is a kind of amplifier for amplifying the output signals from the output interface and supplying the control signals to the actuators, such as fuel injectors 34, the actuator 94 for the idling speed control valve, and the actuator 146 for EGR control valve. The drive circuit 1600 is also connected to the display or indicator 1900 for fault indication, the external check unit 2000 and the vehicle information system 2500. The drive circuit 1600 is connected to the external check unit 2000 via the connector 2010 and data transmission lines 2023, 2022 and 2026. On the other hand, the drive circuit 1600 is connected to the vehicle information system 2500 via the connector 2510 and the data transmission lines 2521, 2522 and 2523.

A back-up circuit 1700 is connected to the shaping circuit 1100 to receive data therefrom. In practice, the back-up circuit 1700 is connected to data lines to receive the crank reference angle signal, the engine temperature signal, starter switch on/off signal and the throttle valve close signal. In turn, the back-up circuit 1700 is connected to the data lines 1755, 1752 and 1751 via data lines 1713, 1712, 1711 and 1701 and a switching circuit 1750 which is, in turn, connected to the output interface 1500 via data lines 1515, 1512 and 1511. On the other hand, the drive circuit 1600 is connected via the actuator line 2026 to the back-up circuit 1700. The back-up circuit 1700 is responsive to the fault indication signal from the drive circuit 1600 to produce a switching signal. The switching circuit 1750 normally establishes communication between the data lines 1513, 1512 and 1511 and the lines 1755, 1752 and 1751 for normal engine control operation. The switching circuit 1750 is responsive to the switching signal from the back-up circuit 1700 via the data line 1701 to connect the data lines 1713, 1712 and 1711 with the data lines 1755, 1752 and 1751 to control the fuel pump 260, the spark advancer 262 and the fuel injectors 34, respectively.

A power circuit 1800 is connected to a vehicle battery 262 via a power switch acting as a main power source to distribute power Vcc to the input interface 1200, CPU 1300, memory 1400, the output interface 1500 and so forth. The power circuit 1800 is also connected to the back-up circuit 1700. The power circuit 1800 produces a signal indicative of the ignition switch on/off positions and reset and halt signals for resetting the controller and temporarily disabling the controller 1000 respectively. The ignition on/off signal from the power circuit is fed to the input interface 1200 via a line 1830. On the other hand, the reset signal and the halt signal are fed to the bus-line 1320 via lines 1840 and 1850. The power circuit 1800 also supplies power to the input interface, the shaping circuit 1100, the drive circuit 1600 and the switching circuit 1750 via lines 1860 and 1870. The power circuit 1800 is also connected to an auxiliary power source which bypasses the power switch to supply power to holding memory 1440 even when the main power switch is turned off.

In the engine control system, the PROM 1420 stores various control programs for controlling engine operation. In addition, the PROM 1420 stores the check program for the fault monitor as one of its background jobs. The check program is executed whenever the CPU 1300 is not busy with the engine control programs. The results of execution of the check program are stored in the non-volatile memory 1450. The non-volatile memory 1450 has a plurality of addresses allocated for each of the check items. The check result data in the non-volatile memory 1450 are read out in response to a request from the input unit 2540 of the vehicle information system 2500 to provide indication or display data to the vehicle information system.

On the other hand, in order to check each check item, particularly for accurately checking input and output signals of the engine control system 1000, it is necessary to eliminate influence due to noise created by various vehicle devices, such as the ignition system. Therefore, the time spent checking each check item must be long enough to compensate for the influence of noise.

In the check program, the crank angle signals from the crank angle sensor 230, the engine coolant temperature signal from the engine coolant temperature sensor 220, the air flow meter signal from the air flow meter 26 and so forth are checked as input signals. On the other hand, the idle air control signal, the EGR control signal, the fuel injection control signal and so forth are checked as output signals. There are various ways to check the input and output signals. For example, the above-mentioned British Prepublication No. 2046964 discloses a check program for completely checking the electronic controller.

A checking procedure applicable to the engine control system as set forth above and equivalent systems has been described in British Patent First Publication, No. 2,125,578, published on Mar. 7, 1984, which corresponds to the co-pending U.S. patent application Ser. No. 405,426, filed Aug. 5, 1982. The checking procedure described in the above-identified British patent first publication is hereby incorporated by reference for the sake of disclosure.

On the other hand, the above-mentioned engine control system is so programmed as to set or update operation patterns of the specific engine from actual engine operation as indicated by the engine operation parameters sensed by the various sensors set forth above. The set operation pattern will be used to project engine behavior in terms of the corresponding control parameters. This engine operation pattern setting procedure will be described below with reference to FIG. 9 which shows the operation of the control system in the form of a block diagram.

The actual engine operation pattern is derived at a block 3100. In order to derive the actual engine operation pattern of the engine, the block 3100 receives as inputs the throttle position indicative signal from the throttle angle sensor 31, the air flow rate indicative signal from the air flow member 26, and the engine speed indicative signal derived from the crank position signal from the crank angle sensor 230. The throttle angle indicative signal values, the air flow rate indicative signal values and the engine speed indicative signal values are each sampled at given intervals over a given period to derive their respective variation patterns. The derived variation patterns are stored in a memory block 3101 in RAM as a series of relative values or amplitude, rather than as physical measurement readings. Throughout the disclosure, the variation patterns of the throttle position indicative signal value, the air flow rate indicative signal value and the engine speed indicative signal values will be referred to as "actual operation pattern data AOPD".

Recognition of an actual pertinent engine operating state is performed at a block 3400. In order to recognize this engine operating state presaging engine stall, the block 3400 receives as inputs the engine coolant temperature indicative signal from the engine coolant temperature sensor 220, the throttle position indicative signal from the throttle angle sensor 31, the air flow rate indicative signal from the air flow meter 26, the engine speed indicative signal, the air conditioner condition indicative signal from the air conditioner switch 260 and the transmission gear position indicative signal from the transmission neutral switch 240. As set forth above, the air conditioner position indicative signal and the transmission gear position indicative signal are binary, ON/-OFF-type signals. For instance, the air conditioner indicative signal value remains HIGH as long as the air conditioner is operating and the transmission gear position signal value remains low as long as the transmission gear is in any gear other than neutral and/or park. The block 3400 is adapted to detect unstable operating states of engine such as near-stall, acceleration, deceleration, or transmission gear shift. The actual engine operating parameter values recorded upon detection of an unstable state will be referred to as "actual engine operating condition data AEOCD".

The actual engine operation pattern data AOPD is fed to a block 3300, in which the projected engine operation pattern is derived. The block 3300 is also connected to a block 3200 for deriving an engine operation influencing parameter. The block 3200 receives the air conditioner position indicative signal from the air conditioner switch 260 and the transmission gear position indicative signal from the transmission neutral switch 240. An engine operation influencing parameter, which will be referred to as "engine operation influencing parameter EOIP" is derived from the air conditioner position indicative signal and the transmission gear position indicative signal. The block 3300 receives the actual operation pattern data AOPD from the block 3100 and the engine operation influencing parameter EOIP from the block 3200. In the block 3300, possible variations in engine operation are projected on the basis of the actual operation pattern data and the engine operation influencing parameter. The block 3300 responds to changes in the engine operation influencing parameter EOIP by accessing an appropriate memory block in RAM to read previously set pattern data in terms of the engine operation influencing parameter EOIP and the actual operation pattern data AOPD. In practice, variation patterns of the throttle angle position, engine speed, intake air flow rate are projected in accordance with the engine operation influencing parameter, among others. The data representative of the variation patterns of the engine operating parameters will be referred to as "operating parameter variation data OPVD". If the operating parameter variation data OPVD are not initialized during vehicle assembly, the actual operation pattern data AOPD from the block 3100 may be set in the appropriate memory block in RAM as operating parameter variation data OPVD.

A block 3500 receives the actual operation pattern data AOPD and the actual engine operating condition data AEOCD from the block 3400. The block 3500 responds to specific preselected specific engine operating conditions such as engine stall, acceleration, deceleration, or transmission gear shift as indicated by the actual engine operating condition data AEOCD. The block 3500 becomes active when any of the specific engine operating conditions is indicated by the actual engine operating condition data. The block 3500 triggers the COP to record the actual operation pattern data in a corresponding memory block among a plurality of memory blocks referred to as "pattern memory 1440" allocated for the actual operation pattern data of various engine operating conditions. In the pattern memory, some of pattern data is initially set during installation of the control system in the vehicle in the factory. The data corresponding to the actual operation pattern data AOPD arrayed in terms of the actual engine operating condition data AEOCD will be referred to as "set engine operation pattern data SEOPD".

The set engine operation pattern data SEOPD is sent to a block 3600 in addition to the pattern memory 1440. The block 3600 also receives the operating parameter variation data OPVD from the block 3300. The block 3600 projects possible future engine operation patterns on the basis of the set engine operation pattern data and the operating parameter variation data. In practice, projection of future engine operating patterns is made by reading out one group of the set engine operation pattern data SEOPD corresponding to or most closely corresponding to the engine operating parameters represented by the operating parameter variation data OPVD. The data projected by the block 3600 will be referred to hereafter as "projected engine operation pattern data PEOPD".

The projected engine operation pattern data PEOPD are used to correct various engine control signal values such as the fuel injection control signal, the ignition timing control signal, the EGR control signal, and the idling air or auxiliary air flow rate control signal derived in a block 3700. It should be appreciated that the block 3700 performs various engine control operations on the basis of the engine operating parameters. Procedures for deriving these control values are well known. For example, derivation of fuel injection amount is disclosed in U.S. Pat. No. 4,319,327, to Higashiyama et al. Another fuel injection amount control technique is disclosed in U.S. Pat. No. 4,459,670 to Yamaguchi et al. This fuel injection control also includes a fuel injection timing control. This fuel injection timing control is disclosed in European Patent First Publication No. 0084116, published on July 27, 1983. Spark ignition control includes spark ignition timing control, spark ignition advance control and dwell angle control. Such a spark ignition control system has been disclosed in U.S. Pat. No. 4,376,428, to Hata et al, for example. Auxiliary air flow rate control is discussed in U.S. Pat. Nos. 4,406,261, 4,345,557, 4,402,289, 4,406,262, 4,344,398 to Ikeura. Finally, idling speed control, including derivation of a mathematically obtained dynamic model for projecting possible engine idling variations, has been disclosed in German Patent First Publication (DE-OS) No. 33 33 392 published on Mar. 22, 1984, which corresponds to the co-pending U.S. patent appication Ser. No. 532,555, filed on Sept. 15, 1983. The contents of the above-identified publications is hereby incorporated by reference for the sake of disclosure.

The control signal values derived in the block 3700 are corrected in accordance with correction values derived on the basis of the projected engine operation pattern data PEOPD in order to optimize engine performance and minimize fuel consumption and pollution by exhaust gas. Also, the control signal values derived by the block 3700 are corrected in terms of the projected engine operation pattern data PEOPD for prevention of engine stalling when the projected engine operation pattern data indicates the possibility of stalling. Engine stall prevention procedures will be described in greater detail hereafter with reference to FIGS. 4 to 14.

Figure 10:
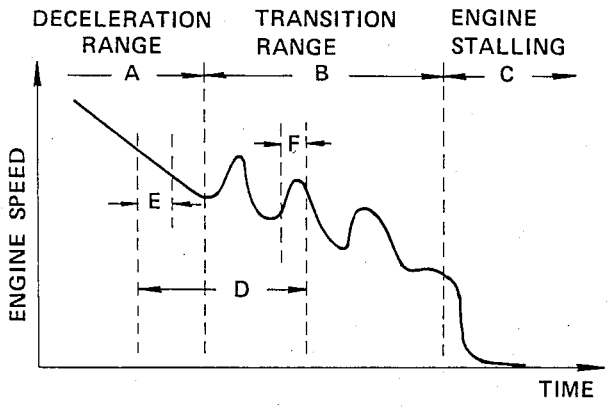
FIG. 10 shows a typical pattern of engine speed variation resulting in engine stalling.

FIG. 10 shows one typical pattern of variation of engine speed when the engine stalls. In DECELERATION RANGE A, the throttle valve may be fully closed or nearly closed so that intake air enters only through the auxiliary air passage. At the same time, fuel cut-off may be performed to conserve fuel. At the end of the range A, the clutch is released (in the case of manual power transmission) or the transmission is shifted to a lower gear ratio (in the case of automatic power transmission), so that the relative load on the engine is reduced to allow the engine to turn at a higher speed. If the engine including the air induction system, the fuel injection system, the exhaust system and so forth, are operating well, the transition between engine deceleration and engine idling may be relatively smooth. In this case, engine speed drop gradually and steady towards the set engine idling speed. In this case, engine stalling will never occur and thus engine stall preventive procedures need not be performed.

However, if the fuel supply system is not operating well, allowing the air/fuel mixture rate to deviate far from stoichiometry, cycle-to-cycle fluctuation of the engine output torque will occur. Similar fluctuations may occur when the release timing of clutch of the manual transmission or the shift-down timing of the automatic transmission is too late, spark ignition timing is retarded too much, or the air induction rate fluctuates due to deposition of carbon or the like on the inner surfaces of the induction passage. Cycle-to-cycle fluctuations in engine output torque may cause hunting of engine speed, as shown in the TRANSITION RANGE B. This sometimes results in engine stalling, as indicated in the "ENGINE STALLING" range C.

According to the present invention, variation of the engine speed during the range D in FIG. 10 is set in the pattern memory 1440 as stall-representative set engine operation pattern data SEOPD. In the shown example, the possibility of engine stalling is recognized upon detection of engine speed variations corresponding to the engine stall-representative set engine operation pattern data SEOPD. In order to prevent the engine from falling into engine stalling pattern, engine stall preventive procedure is to be performed taken during the interval D in FIG. 10. In this engine stall preventive procedure, the air conditioner switch is temporarily turned off, the air conditioner is temporarily disabled, or an auxiliary drive unit assisting the engine is activated to increase the relative torque of the engine.

In practice, the engine stall representative set engine operation pattern data SEOPD is recognized during the interval E and the engine stall preventive procedure is performed during the interval F.

Figure 11:
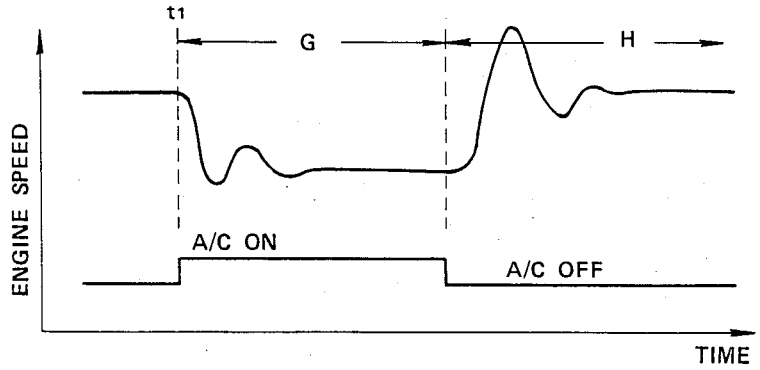
FIG. 11 shows the variation of engine speed in response to switching an automotive air conditioner ON and OFF.

FIG. 11 shows typical engine speed variations in response to changes in air conditioner operating state. During an interval in FIG. 11, the air conditioner is operating and a clutch of a compressor of the air conditioner is in engaged to transmit engine output torque to the compressor. In this case, the compressor of the air conditioner acts as additional load on the engine. Due to this additional load, the engine speed remains relatively low. When the air conditioner is not operating or the air conditioner compressor clutch is disengaged, a reduced load or essentially no load is applied to the engine through the air conditioner compressor. As overall load applied to the engine is thus reduced, the engine speed raises increases, as shown at H in FIG. 11. This pattern of variation of the engine speed relative to the air conditioner operating state is recorded as the operating parameter variation data OPVD in RAM. This operating parameter variation data OPVD to be accessed in terms of the air conditioner condition will be referred to as "air conditioner dependent operating parameter variation data ACOPVD". It is assumed that engine speed will vary according to the pattern illustrated in the range G in response to closure of the air conditioner switch. On the other hand, engine speed variations according to the pattern illustrated in the region H in response to opening of the air conditioner switch can be expected. The air conditioner dependent operation parameter variation data ACOPVD are used as part of the engine stall preventive operation whenever conditions matching the engine stall representative set engine operation pattern data SEOPD are recognized.

Figure 12:
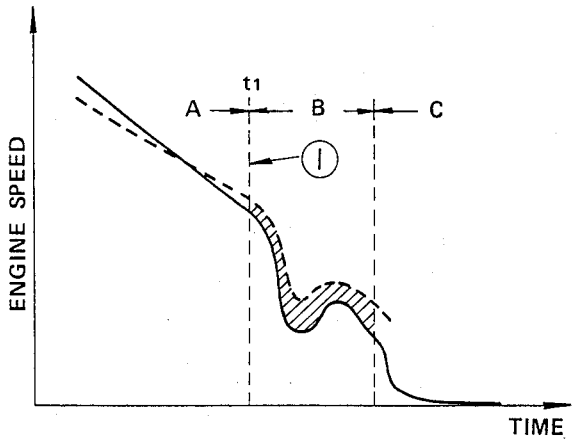
FIG. 12 illustrates a method of selecting a present engine operation pattern by comparing current and prerecorded variation patterns of engine operation parameters.

FIG. 12 shows the relationship between the engine stall representative set engine operation pattern data SEOPD and the air conditioner dependent operation parameter variation data ACOPVD. Assume the engine speed is changing smoothly as illustrated by solid line a. When the air conditioner switch is turned ON at the time point $t_1$, air conditioner dependent operation parameter variation data ACOPVD as illustrated by the broken curve b is read out. The data SEOPD and ACOPVD are compared to calculate the area illustrated in hatching, which is representative of the integrated deviation therebetween. If area is smaller than a predetermined value, there is a high probability of engine stall if the stall preventive operation is not performed. Accordingly, the stall preventive operation is triggered. On the other hand, if the calculated area exceeds the predetermined value, the probability of engine stall is acceptably low. Therefore, in this case, stall preventive operation need not be performed.

Figure 20:
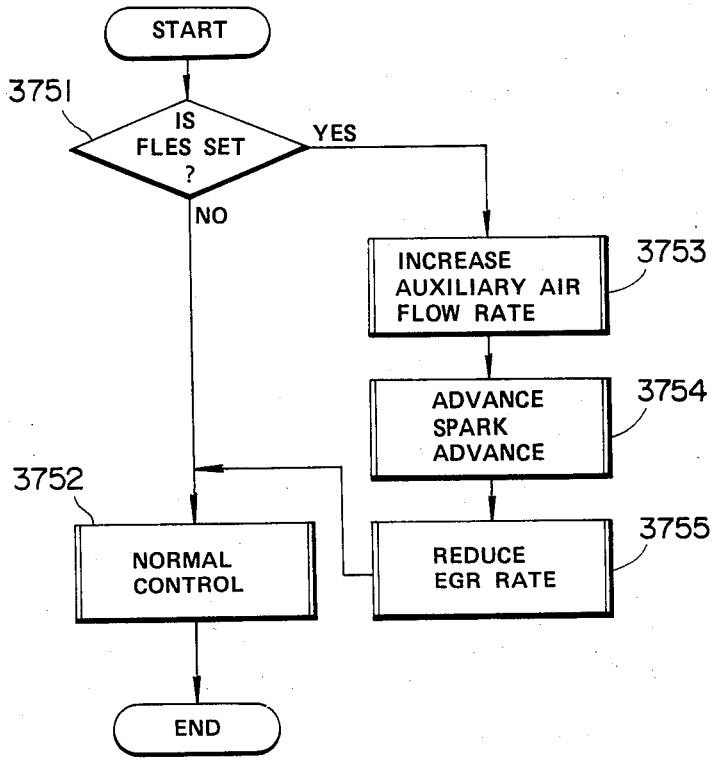
FIG. 20 is a flowchart of an engine control program to be executed by the controller of FIG. 8.

FIGS. 14 to 20 are flowcharts of programs to be executed by the engine control system of FIGS. 7 and 8. As will be appreciated, the flowcharts of FIGS. 14 to 19 illustrate a sequence of routines for deriving the engine stall representative set engine operation pattern data to be used. The program formed by combining FIGS. 14 to 19 will be referred to as "engine operation projecting program". The program of FIG. 20 is executed to prevent the engine from stalling, and so will be referred to as "engine stall prevention program".

The engine operation projecting program is triggered at given intervals. The timing of execution of the engine operation projecting program is governed by the operation timer circuit 1350.

Figure 14:
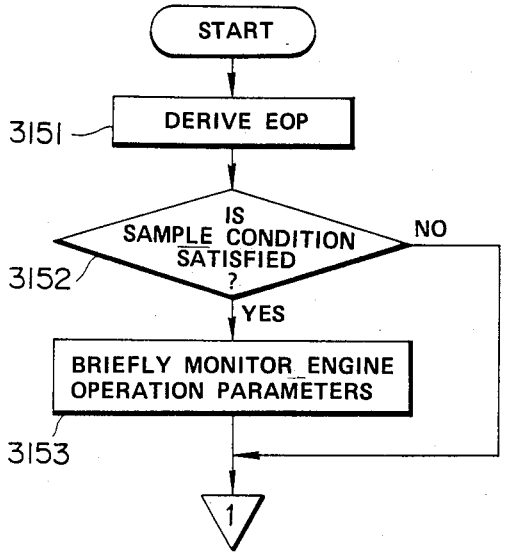
FIGS. 14 to 19 are a sequence of flowcharts of an engine operation pattern projecting program to be executed by the controller of FIG. 8, each figure showing the operation of one of the blocks in FIG. 9.

In this disclosure, the engine operation projecting program is separated into six portions which respectively correspond to the blocks 3100, 3200, 3300, 3400, 3500 and 3600. For instance, the routine in FIG. 14 represents the operation of the block 3100. Similarly, each of the routines shown in FIGS. 15 to 19 represent the operation of the blocks 3200, 3300, 3400, 3500 and 3600 respectively.

Immediately after starting execution of the engine operation projecting program, the actual engine operation pattern data AOPD is derived at a block 3151, as shown in FIG. 14. In this block, the throttle angle position indicative signal value St, the intake air flow rate indicative signal value Sq and engine speed indicative signal values Sn are processed to derive the actual engine operating condition. The engine operating pattern EOP derived in the block 3151 is checked against various preset patterns in ROM to judge whether the engine operating conditions merit comparison with variation patterns in the RAM, at a block 3152. If the engine operating pattern EOP matches one of the preset patterns, the input engine operation parameters are sampled repeated over a predetermined, short period of time to derive a variation pattern for each, at a block 3153.

Although the disclosure with respect to FIG. 9 recites that the block 3100 derives variation patterns and outputs pattern data for each of the input parameters, i.e. throttle angle variation, intake air flow rate variation and engine speed variation, hereinafter only the engine speed factor will be explained in detail for simplicity.

The sampled engine speed value to be used as the engine actual operation pattern data AOPD may be temporarily written in an appropriate register in CPU.

If the engine operation pattern does not match any of the preset patterns, the block 3153 is skipped. After skipping or executing the block 3153, control passes to a block 3251 of FIG. 15. From the block 3251, the operation of the block 3200 begins.

In the block 3251, the engine operation influencing parameter EOIP is checked. Though the operation of the block 3200 of FIG. 9 is described as to check the air conditioner position and the transmission gear position (transmission neutral position), for simplicity, only the air conditioner switch position will be considered in this description. Therefore, at the block 3251, the air conditioner switch 260 is checked to see whether or not the air conditioner switch 260 has just been operated. For instance, at the block 3251, the presence of a leading or trailing edge of an air conditioner switch signal pulse is checked for. If the air conditioner switch position remains unchanged, control passes to another routine for checking other engine operating influencing factors such as the transmission gear position.

If the air conditioner switch 260 has just been operated when checked at the block 3251, then the air conditioner switch 260 is checked to see if it has just been closed or opened, in a block 3252. If the air conditioner has just been closed, the memory block storing air conditioner dependent operation parameter variation data ACOPVD is accessed to read out the engine speed variation pattern specific to closure of the air conditioner switch, such as is illustrated in the range G of FIG. 11, at a block 3253. On the other hand, if the air conditioner switch 260 has just been opened, the air conditioner dependent operation parameter variation data ACOPVD representative of the engine speed variation pattern in response to opening of the air conditioner switch 260 such as is illustrated in the range H of FIG. 11 is read out from the corresponding area of RAM, at a block 3254.

Figure 9:
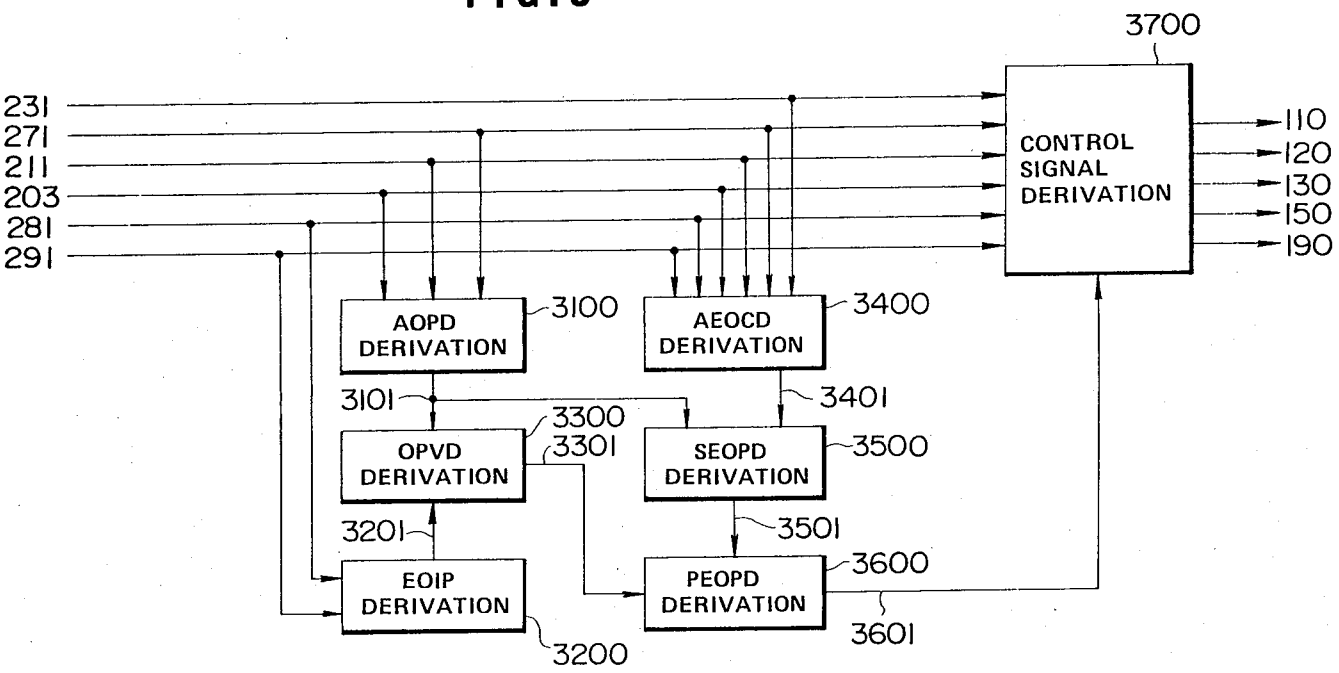
FIG. 9 is a block diagram of the operation of the control system of FIG. 8.
Figure 13:
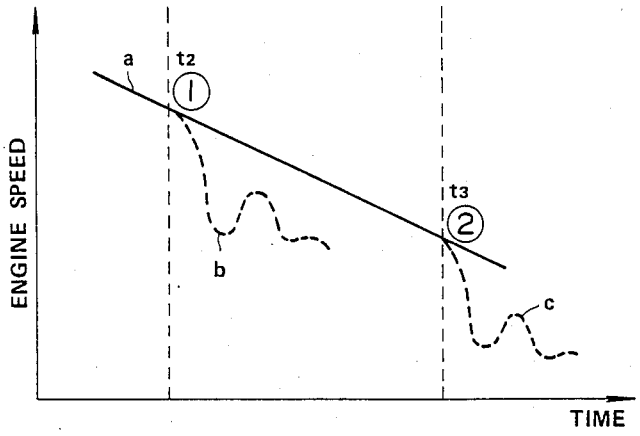
FIG. 13 illustrates a method of applying the projected engine operation pattern to actual control.

After execution of either of the blocks 3253 and 3254, control passes to a block 3351, corresponding to the block 3300 of FIG. 9. The engine speed variation data used as the actual operation pattern data AOPD is read out in the block 3351. The current engine speed value is added to each of the engine speed variation data to form a projected engine speed behavior curve from the normalized recorded data. Namely, in the block 3351, the engine speed at initial time points $t_2$ or $t_3$ in FIG. 13 are taken to be the initial engine speed values. The operating parameter variation data OPVD are then derived from the initial engine speed value obtained in the block 3351 and the air conditioner dependent operation parameter variation data ACOPVD, at a block 3352. This operating parameter variation data OPVD is illustrated in FIG. 13 by broken lines b and c.

In practice, derivation of the operating parameter variation data OPVD is performed by adding the air conditioner dependent operation parameter variation data ACOPVD derived in either the block 3253 or the block 3254 to the initial engine speed value in place of actual operation pattern data AOPD. This is because the engine stall operation involves only ON/OFF operations, such as switching off the air conditioner. In cases where, fuel supply or air flow are adjusted continuously to prevent stalling the full pattern data will be used for control over a specified period.

After execution of the block 3352, control passes to the block 3451 which corresponds to the block 3400. At the block 3451, the instantaneous engine speed N is checked to see if the speed is equal to or lower than 20 rpm. If so, engine stall is recognized and control passes to a block 3452. In the block 3452, an engine stall representative flag FLES is set in a flag register 1302 in CPU 1300. Otherwise, i.e. when the engine speed is higher than 20 rpm, the engine is recognized to be running and the engine stall representative flag FLES in the flag register 1302 is reset at a block 3453.

After execution of either the block 3452 or the block 3453, control passes to a block 3551, which corresponds to the block 3500. At the block 3551, the engine stall representative flag FLES is checked. If the engine stall representative flag FLES is set when checked in the block 3551, then the operating parameter variation data OPVD is stored in the pattern memory 1440, in a block 3552. After execution of the block 3552 or when the engine stall representative flag FLES is not set, control passes to a block 3651. In the block 3651, the memory blocks storing the engine stall representative set engine operation pattern data SEOPD are accessed in sequence. Each of the memory blocks storing the engine stall representative set engine operation pattern data will be referred to as a "SEOPD address".

In the first cycle of operation subsequent to execution of the block 3551 or 3552, the first SEOPD address is accessed to read the first engine stall representative set operation pattern data from the pattern memory 1440. In a block 3652, the read out pattern data SEOPD are compared with the operating parameter variation data OPVD described with reference to FIG. 11. In the block 3652, the hatched area in FIG. 11 is measured. The obtained area which will be hereafter referred to as "deviation indicative area DIA", is compared with a predetermined value Aref, at a block 3653. If the deviation indicative area DIA is equal to or less than the predetermined value Aref, then the pattern data SEOPD is latched at a block 3655. Otherwise, the SEOPD address to be accessed is shifted to the next one at a block 3654. Then, control returns to the block 3651 to read out the SEOPD data from the next SEOPD address. The blocks 3651, 3652, 3653 and 3654 form a loop to be repeated to check the operation parameter variation data OPVD against each SEOPD data pattern in sequence until the corresponding or the closest SEOPD pattern is found out.

When the engine stall-representative set operation pattern data matching or approximately matching the current operation parameter variation data OPVD is found at the block 3653, the pattern data SEOPD is latched at the block 3655. The engine operation projecting program then ends.

FIG. 20 shows the control program which is executed at regular intervals. For example, the control program may be executed in synchronism with engine revolution in response to the crank reference signal. Immediately after starting execution, the engine stall representative flag FLES is checked at a block 3751. When the reset condition of the engine stall representative flag FLES is detected, the controller performs normal engine control operations in a block 3752 to control auxiliary air flow, fuel injection, spark ignition, air/fuel mixture rate, exhaust gas recirculation and so forth on the basis of the various engine operation parameters, such as engine load, engine speed, engine coolant temperature, oxygen concentration in the exhaust gas, and throttle valve angular position. The engine control operations performed in the block 3752 may be conventional and need not be discussed in detail here.

On the other hand, if the engine stall representative flag FLES is set when checked at the block 3751 and thus probable engine stall is recognized, a stall preventive routine represented by the blocks 3753, 3754 and 3755 is executed. In the block 3753, an increment to the auxiliary airflow rate is realized. An auxiliary air flow control signal with increased duty cycle indicative of the incremented auxiliary air flow rate is thus transmitted to the actuator 94 of the pressure regulating valve 94. Increasing auxiliary air flow rate increases the total intake air flow rate and thus the air/fuel mixture supply to the engine combustion chamber. This results in an increase in engine output torque, preventing the engine from stalling.

In accordance with the increase in the auxiliary air flow rate in the electronic auxiliary air control, also called the idle air control, a target engine speed is modified to a higher value in a closed control loop. Increasing the target engine speed modifies the duty cycle of the control signal to increase the auxiliary air flow rate, resulting in an increase in the engine speed toward the modified target engine speed. Alternatively, an increase in the flow rate may be achieved by open loop control. Closed loop control would involve some response lag while open-loop control makes precise engine speed control more difficult. Therefore, in practice, the initial auxiliary air flow rate modification may be performed by open-loop control and thereafter control is switched to the closed loop control mode.

In the block 3754, the spark ignition control, particularly for controlling spark advance, is performed. In the electronic spark ignition control, the spark ignition angle is advanced in a per se well-known manner to increase the engine output torque.

If necessary, in the block 3754, the dwell angle can be also increased to provide increased ignition power to the spark plugs. This reliably prevents misfiring in the engine combustion chamber and thereby ensures engine stall prevention.

In the block 3755, the exhaust gas recirculation rate is reduced. This can be achieved by reducing the duty cycle applied to actuator 140 of the pressure regulating valve 68. Reducing the non-combustionable component in the mixture in the engine cylinder, ensures ignition and self-sustained combustion in the engine combustion chamber.

If necessary, it is also possible to perform engine stall preventive control by temporarily reducing the load on the engine due to the engine-driven vehicle components, such as the air conditioner. In this case, a switching relay may be inserted within air conditioner circuitry to interrupt the powe supply temporarily during the engine stall preventing operation. Alternatively, an external driving unit can be connected to the engine to provide additional torque during the engine stall preventing operation. Such air conditioner control, and use of an auxiliary driving unit have been disclosed in the co-pending U.S. patent application filed on the same day as this application, and entitled ELECTRONIC CONTROL SYSTEM FOR INTERNAL COMBUSTION ENGINE WITH STALL PREVENTIVE FEATURE AND METHOD FOR PERFORMING STALL PREVENTIVE ENGINE CONTROL. The contents of the above-identified co-pending U.S. patent application is hereby incorporated by reference for the sake of disclosure.

The increments to the auxiliary air flow rate, and the spark advance angle and the decrement to the exhaust gas recirculation rate may be adjusted continuously in accordance with the projected engine operation pattern data PEOPD. The increments to the auxiliary air flow rate, and the spark advance angle and/or the decrement to the exhaust gas recirculation rate may be functions of the PEOPD, or, alternatively, may be derived by table look-up in appropriate correction tables accessed in terms of PEOPD.

It should be noted that in the embodiment above, the operation has been described in terms of monitoring solely variations in engine speed. However, practical application of this engine control technique should involve various engine operation parameters, such as throttle valve angular position, intake air flow rate, engine speed, vehicle speed, engine coolant temperature, air conditioner switch position, and transmission gear position. Each of this parameters may serve as one of several factors defining the actual engine operating condition as a measure of the current dynamic status of the engine. In other words, the engine operating condition may be recognized as a combination of these parameters. Accordingly, the set engine operation pattern data SEOPD will consist of numerous combinations of these parameters experienced duration or immediately prior to specific unstable engine operating conditions, such as engine stall, engine acceleration, deceleration and transmission gear shifting. Also, in order to recognize the preselected engine operating conditions under which to update the SEOPD, various combinations of parameters would be preset to represent specific engine operating conditions.

When the specific engine operating conditions are recognized and thus the PEOPD are output, the normal engine control signals may be modified by correction values derived on the basis of the PEOPD corresponding to the recognized engine operating condition, i.e., the instantaneous dynamic status of the engine.

FIGS. 21 to 25 show modifications to the preferred embodiment of control system according to the present invention.

Figure 21:
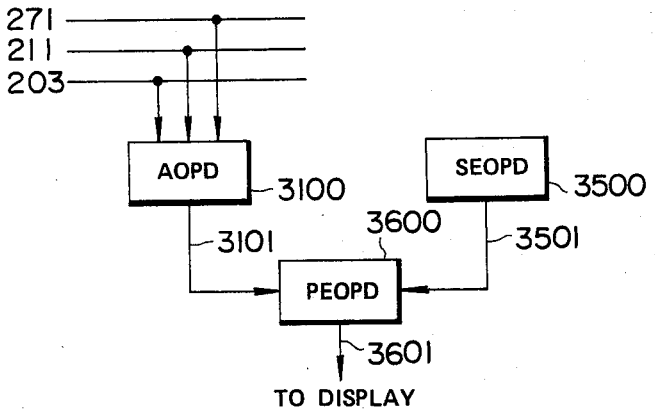
FIG. 21 is block diagram showing a modification to the operational block diagram in FIG. 9.

FIG. 21 shows a modification of the operational block diagram of FIG. 9 of the controller of FIGS. 7A, 7B and 8. This modification is intended to display the projected engine operation pattern on a display device. The PEOPD derivation block 3600 is connected to the display unit 1900 of FIG. 8. Alternatively, the PEOPD derivation block 3600 may be connected to the checker unit 2000 or the vehicle information system 2500 to display the projected engine operation pattern on the associated display units.

The PEOPD derivation block 3600 is also connected to receive inputs from the SEOPD derivation block 3500 and the AOPD derivation block 3100. As set forth above, the output of the AOPD derivation block is indicative of the actual operating pattern data of the engine and the output of the SEOPD derivation block 3500 is indicative of the set engine operation pattern data read out in terms of the engine operating condition such as engine stalling, accelerating or decelerating. In the block 3600, input patterns are compared in the manner set forth with respect to FIG. 12 to derive the projected engine operation pattern data PEOPD. This PEOPD is fed to the display unit 1900 as well as the control signal derivation block 3700 of FIG. 9. At the same time, the PEOPD is also fed to the non-volatile memory for storage when one of the specific engine operating conditions, such as engine stall, occurs. Displaying and storing the PEOPD upon occurrences of the specific engine operating conditions will expedite checking of the control system in the maintenance shop or the factory.

Figure 22:
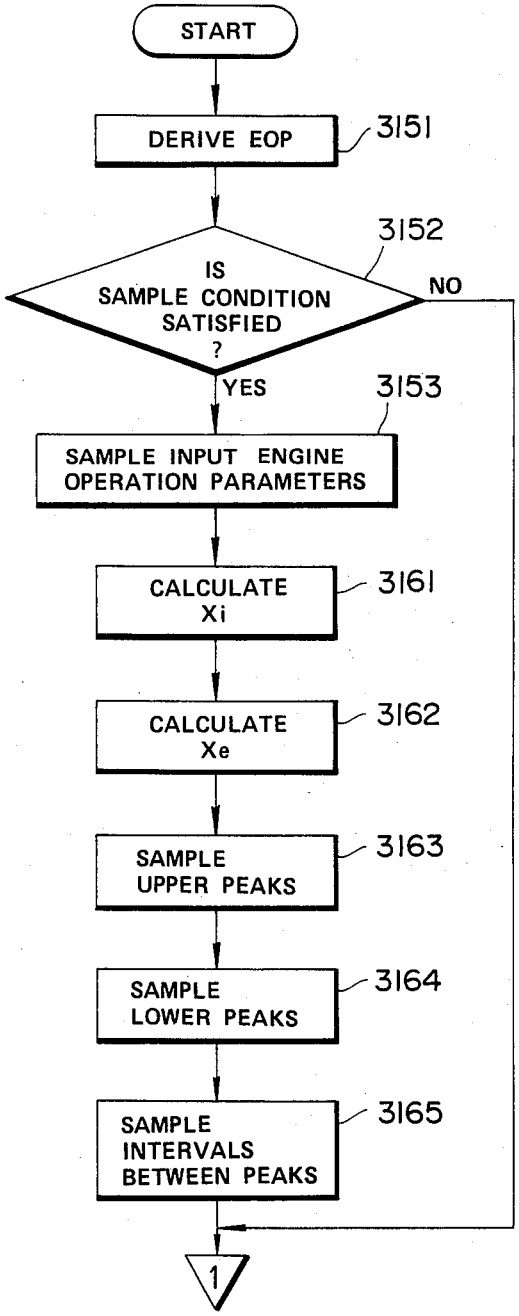
FIG. 22 is a flowchart of a modified form of the routine of FIG. 14.

FIG. 22 shows a routine which samples the actual engine operation parameters and which is a modification of the routine set forth with respect to FIG. 14. In this embodiment, instead of recording all of the sampled engine operating parameter values as pattern or variation characteristics, only the upper and lower peak values and the intervals between the peaks are used to represent the engine operating pattern. As in the routine of FIG. 14, first the engine operating condition EOP is detected on the basis of engine operating parameters. The detected engine operating condition EOP is checked against predetermined conditions to determine whether the predetermined engine operation parameter sampling condition is satisfied, at the block 3152. When the sampling condition is satisfied when checked at the block 3152, engine operation parameters are sampled periodically over a given sampling period. Thereafter, the average value Xi of the sampled values of each engine operation parameter within an initial first period, such as E in FIG. 10, is derived at a block 3161. Subsequently, the average value Xe of the sampled values within a given final period, e.g. F in FIG. 10, of each engine operation parameter is derived at a block 3162. Thereafter, all of the maxima values Pmax and minima values Pmin are derived at blocks 3163 and 3164. Then, the intervals between each set of peaks are measured.

In this modification, the average values Xi and Xe, the peak values Pmax and Pmin and the intervals between the peaks may be used as engine operation variation characteristics. This data is equivalent to the AOPD derived by the routine in FIG. 14 and derived in the block 3100. When this modification is applied to the control system, the set engine operation pattern data are compared with the operation parameter variation data OPVD, both of which are in the form of data indicative of the average values, peak values and intervals between the peaks.

Since this modification reduces the required storage capacity for engine operation pattern data and other data for operating the system, control program run time is reduced, resulting in better response characteristics for the control system overall. Furthermore, since the required memory capacity is reduced, the system can be manufactured at a lower cost than that required for the first embodiment.

Figure 23:
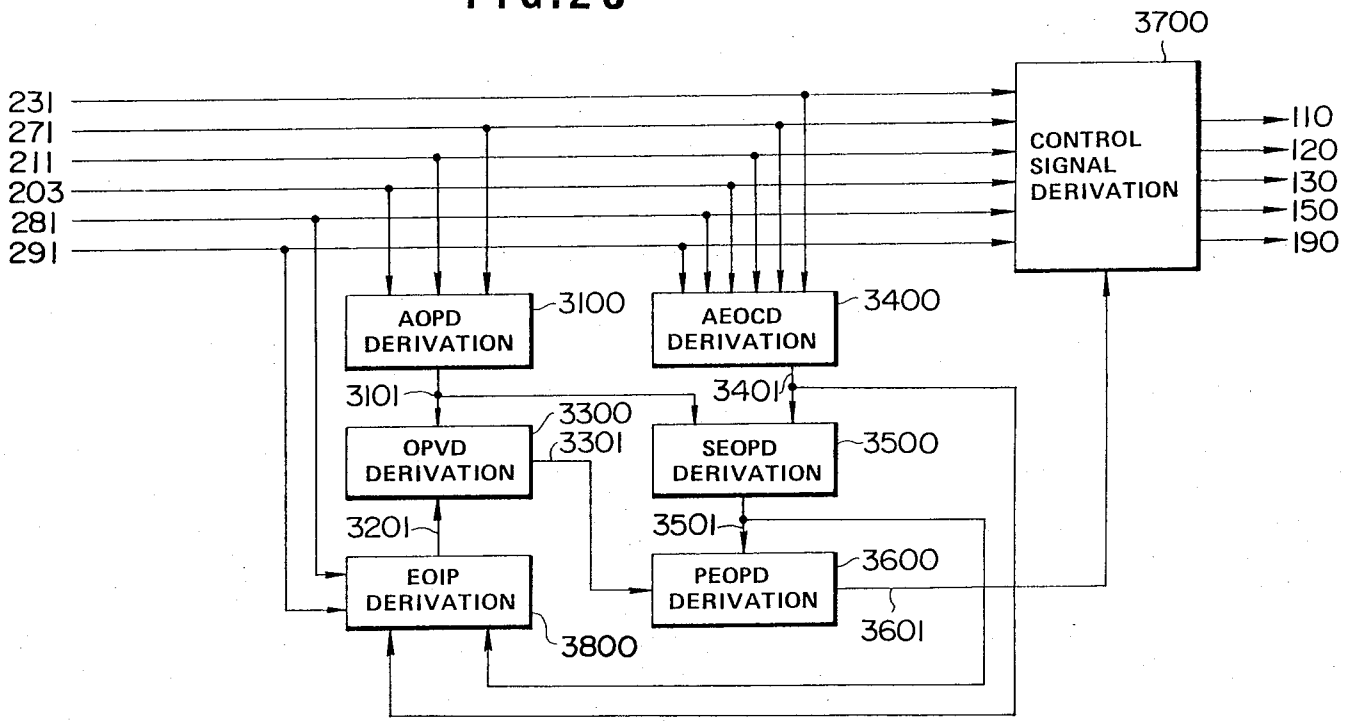
FIG. 23 is a block diagram showing another modified form of the operational block diagram of FIG. 9.

FIG. 23 shows a modification to the control system illustrated in FIG. 9. In this modification, the EOIP derivation block 3800 is connected to the air conditioner switch 260 and the transmission neutral switch 240 as in the preceding preferred embodiment. The EOIP derivation block 3800 is also connected for input from the AEOCD derivation block 3400 and the SEOPD derivation block 3500. The EOIP derivation block 3800 responds to the AEOCD from the block 3400 by comparing the SEOPD value with a predetermined reference value and saving the difference between the SEOPD value and the reference value as a EOIP data. Therefore, the EOIP data can be recorded and/or updated each time the specific engine operating condition occurs. The saved EOIP data corresponding to the engine operating condition represented by the AEOCD from the block 3400 is output to the OPVD derivation block 3300.

Figure 15:
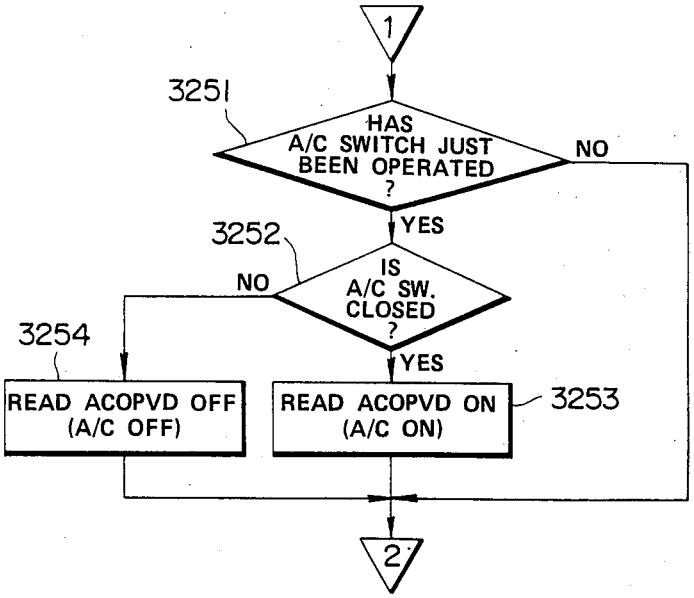
Figure 16:
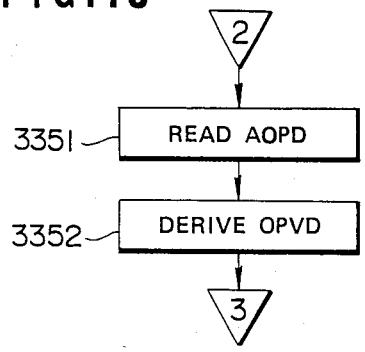
Figure 17:
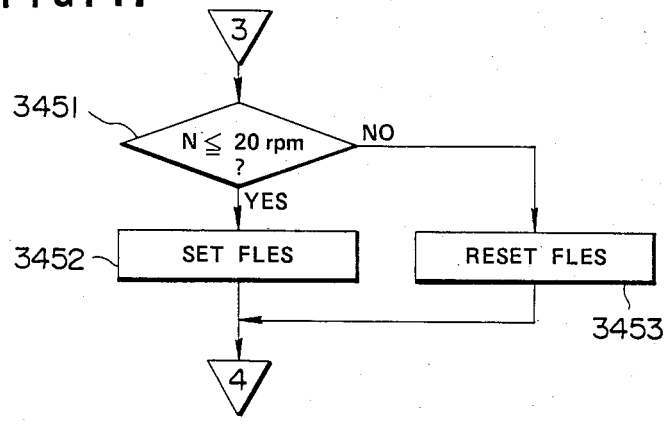
Figure 24:
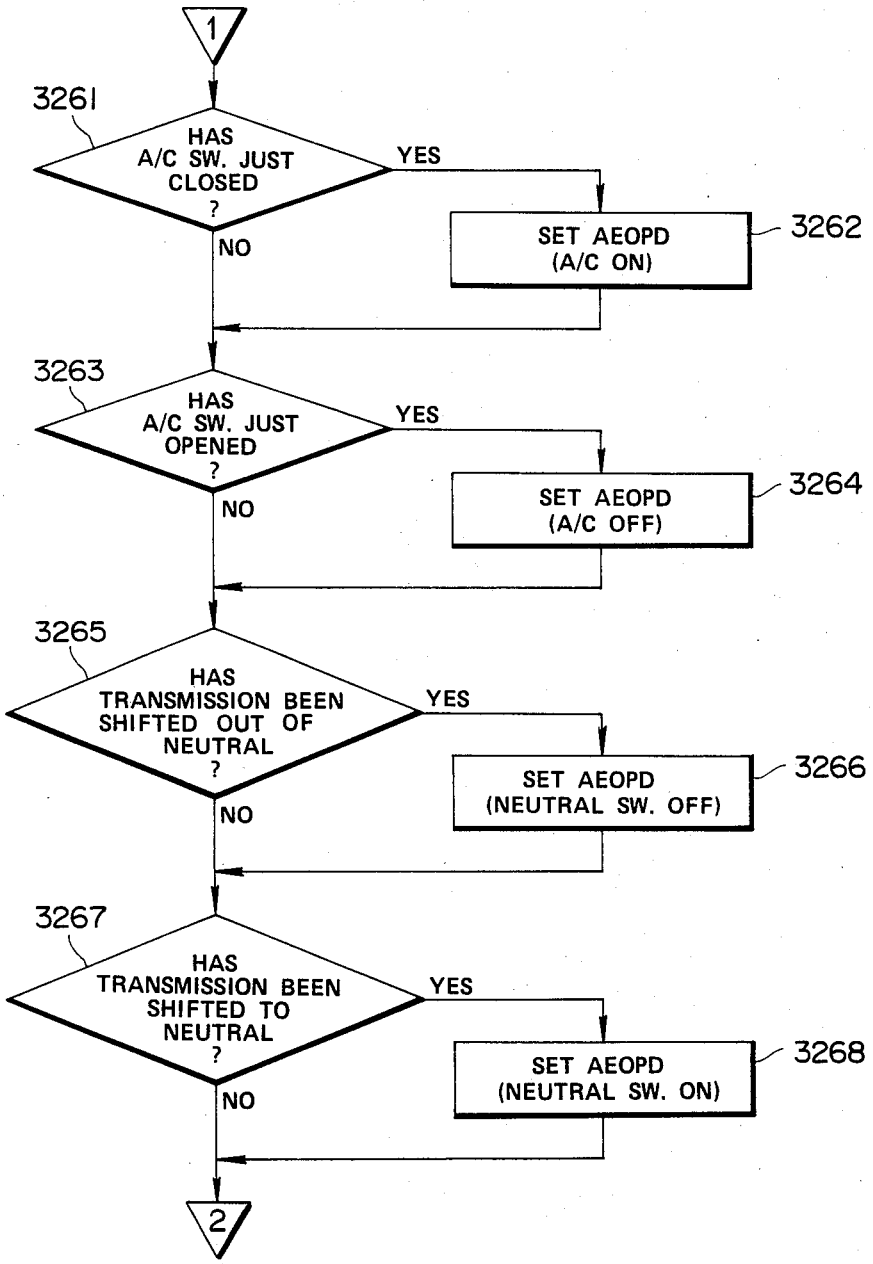
FIG. 24 is a flowchart of a program for deriving pattern data of engine operation influencing parameters, interchangeable with the routine in FIG. 15 and corresponding to the EOIP derivation block in FIG. 23.

FIG. 24 shows a modified form of the routine of FIG. 15 which corresponds to the block 3800 of FIG. 23. At first, the air conditioner switch position is checked to see whether it has just turned ON, at a block 3561. This can be done by checking the current actual engine operation pattern data AEOPD in the block 3400 of FIG. 23. For instance, by observing variations in the actual engine operation pattern data, onset of the air conditioner can be recognized by detecting the typical variation patterns in engine operation shown in FIG. 11. The same is true for other conditions as well, such as gear shifting.

When the air conditioner switch is detected as having just been closed at the block 3261, the set engine operation pattern data SEOPD most closely matching the actual engine operation pattern in the block 3500 of FIG. 23 is read out at a block 3262. These set engine operation pattern data are indicative of real engine speed variations in response to closure of the air conditioner switch. In order to convert these into abstract variation characteristics suitable for deriving the OPVD in the block 3300 of FIG. 23, an initial value measured upon closure of the air conditioner switch is subtracted from each of the values in the SEOPD. The abstract variation characteristics can then be stored in an appropriate memory area as the engine operation influencing parameter data EOIP to be used when the air conditioner is turned ON.

After execution of the blocks 3261 and/or 3262, the air conditioner switch is again checked, this time to see if it has just been turned OFF. This also can be done by checking the AEOPD to see if the AEOPD shows an engine operation pattern approximately matching a pattern occurring after opening the air conditioner. If so, the SEOPD corresponding to air conditioner switch-OFF are read out and abstract variation characteristics are derived from these SEOPD, at a block 3264. The obtained engine operation influencing parameter data EOIP are stored in an appropriate memory area for using derivation of the OPVD in the block 3300.

In a block 3265, the actual engine operation pattern data AEOPD is checked once again to see whether it indicates a shift of transmission gear from neutral to any other driving gear position. Since the engine load is increased by shifting the transmission gear position from neutral to any drive position, the engine operation parameters vary according to a specific pattern differing from that occuring when the air conditioner is turned ON. Therefore, by detecting this specific variation pattern of engine operation, transmission gear shifting can be recognized in block 3265. When the transmission is shifted out of neutral, the EOIP corresponding to this gear shift is derived from the corresponding SEOPD output at a block 3266.

Similarly, transmission gear shift from any of the driving gear positions to neutral is checked for at a block 3267 and EOIP data corresponding to a shift into neutral is set at a block 3268.

Figure 18:
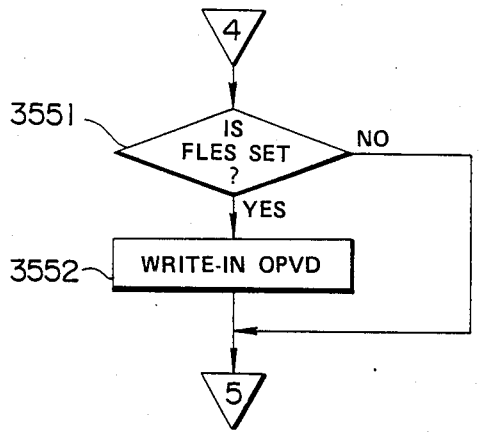
Figure 19:
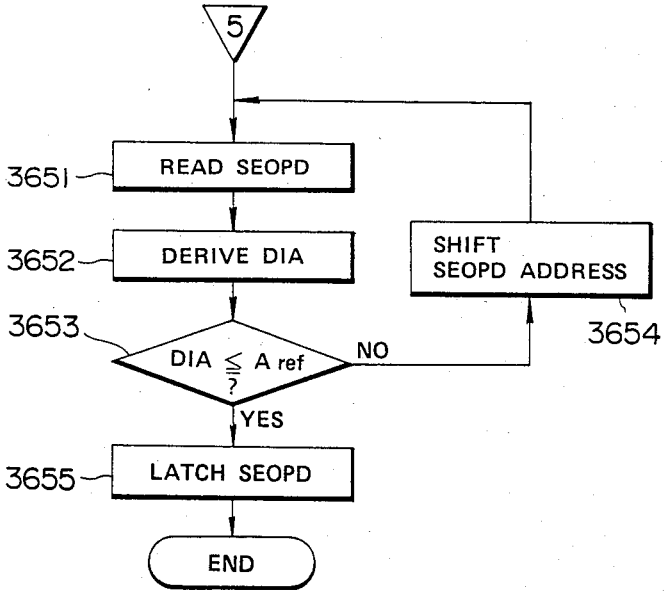
Figure 25:
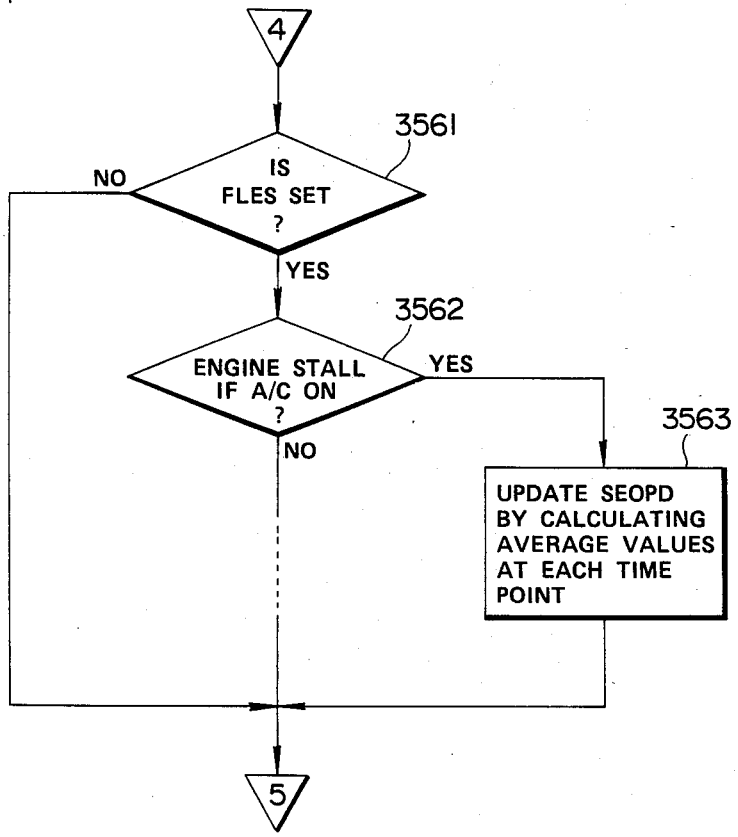
FIG. 25 is a flowchart of a modified form of the routine in FIG. 18.

FIG. 25 shows a modification of the routine of FIG. 18 corresponding to the block 3500. At a block 3561, the engine stall representative flag FLES is checked. If the flag FLES is set then the AEOPD is checked to see if engine conditions indicate a high probability of engine stall if the air conditioner were turned on. This can be done by observing differences in engine operation before and after turning on the air conditioner. When the probability of engine stall in response to turning on the air conditioner is detected, SEOPD indicative of engine stalling pattern is updated at a block 3563. To update the corresponding SEOPD, the prerecorded air conditioner-dependent engine stall pattern-indicative data SEOPD are read out and the values of the preset SEOPD and AEOPD at corresponding time points are averaged. These average values are used to replace the original SEOPD at the block 3563.

Using these average values for the SEOPD eliminates noise from the sensor signals thus preventing any brief, spurious drops in engine speed or other unintentional changes which might lead to engine stall.

As set forth above, in according with the present invention, instantaneous engine operating conditions are detected as a function of variations in several engine operating parameters. More precise control can be performed than in the known art since engine operating conditions can be precisely detected. Furthermore, according to the present invention, by recording various engine operation patterns as model patterns and comparing these preset patterns with continuously monitored engine conditions, probable subsequent engine behavior can be anticipated. Control can be carried out on the basis of projected engine behavior before such changes actually occur. Therefore, response of the control system to variations in the engine operation parameters is accelerated.

Thus, the invention fulfills all of the objects and advantages sought therefor.

What is claimed is:

1. An electronic engine control system for an internal combustion engine comprising:

monitoring means for monitoring a preselected engine operating parameter and for producing a first signal indicative thereof;

means for sampling said first signal and, based on said sampled first signal, recording engine operation pattern data indicative of an actual variation of said preselected engine operating parameter with time;

model means for presetting a model pattern corresponding to a preselected engine operating condition, said model pattern including a portion corresponding to a model variation of said preselected engine operating parameter with time;

comparing means, responsive to said sampling means and said model means, for comparing said engine operation pattern data and said portion of said model data, for determining whether said engine operation pattern data approximately matches said portion of said model pattern, and for producing a match indication if a match is determined; and control means, responsive to said sampling means and said comparing means, for performing engine control and fail safe procedures on the basis of said first signal in the absence of said match indication, and on the basis of said first signal and said model pattern in the presence of said match indication.

2. An electronic engine control system for an internal combustion engine comprising:

means for monitoring preselected engine operating parameters including the operating states of one or more engine accessories and engine-driven components;

means for sampling said engine operating parameters and producing and recording engine operation pattern data including first engine operating parameter-indicative data and a second time-indicative component;

means for presetting a plurality of distinct model patterns, each including components corresponding to those in said engine operation pattern data and each representing a preselected engine operating condition;

means for comparing said engine operation pattern data with each of said model patterns to judge if said engine operation pattern data approximately matches one of said model patterns; and means for performing control and fail-safe operations for the engine, normally solely on the basis of said engine operating parameters and on the basis of said engine operating parameters and the matching one of said model patterns when the engine operation pattern approximately matches one of said model patterns.

3. An electronic engine control system for an internal combustion engine comprising:

means for monitoring a preselected engine operating parameter and producing a first signal indicative thereof;

means for periodically sampling said first signal and producing and recording engine operation pattern data including first engine operating parameter-indicative data and a second time-indicative component;

means for presetting a model pattern including components corresponding to those in said engine operation pattern data and representing a preselected engine operating condition;

means for presetting a reference pattern representative of a specific engine condition and including a proper subset of the information in said first signal;

means for comparing said engine operation pattern data with said reference pattern and replacing said model pattern with said engine operation pattern data when said engine operation data includes said reference pattern;

means for comparing said engine operation pattern data with said model pattern to judge if said engine operation pattern data approximately matches said model pattern; and means for performing control and fail-safe operations for the engine, normally solely on the basis of said first signal, and on the basis of said first signal and said model pattern when the engine operation pattern approximately matches said model pattern.

4. An electronic engine control system for an internal combustion engine comprising:

means for monitoring a preselected engine operating parameter and producing a first signal indicative thereof;

means for sampling said first signal and producing and recording engine operation pattern data including first engine operating parameter-indicative data and a second time-indicative component;

means for presetting a model pattern including components corresponding to those in said engine operation pattern data and representing a preselected engine operating condition;

means for comparing said engine operation pattern data with said model pattern to judge if said engine operation pattern data approximately matches said model pattern;

means for projecting probable immediate changes in engine operating conditions on the basis of said model pattern when said engine operation pattern data matches said model pattern to derive a projected engine operation pattern; and means for performing control and fail-safe operations for the engine, normally solely on the basis of said first signal, and on the basis of said first signal and said projected engine operation pattern when the engine operation pattern approximately matches said model pattern.

5. An electronic engine control system for an internal combustion engine comprising:

means for monitoring a preselected engine operating parameter and producing a first signal indicative thereof;

means for sampling said first signal and producing and recording engine operation pattern data including first engine operating parameter-indicative data and a second time-indicative component;

means for presetting a model pattern including components corresponding to those in said engine operation pattern data and representing a preselected engine operating condition;

means for means for presetting a reference pattern representative of a specific engine condition and including a proper subset of the information in said first signal;

means for comparing said engine operation pattern data with said reference pattern and replacing said model pattern with said engine operation pattern data when said engine operation pattern data includes said reference pattern;

means for comparing said engine operation pattern data with said model pattern to judge if said engine operation pattern data approximately matches said model pattern;

means for projecting probable immediate changes in engine operating conditions on the basis of said model pattern when said engine operation pattern data matches said model pattern to derive a projected engine operation pattern; and means for performing control and fail-safe operations for the engine, normally solely on the basis of said first signal, and on the basis of said first signal and said projected engine operation pattern when the engine operation pattern approximately matches said model pattern.

6. An electronic engine control system for an internal combustion engine comprising:

means for monitoring preselected engine operating parameters and producing a first signal indicative thereof;

means for sampling said first signal and producing and recording engine operation pattern data including first engine operating parameter-indicative data and a second time-indicative component;

means for presetting a plurality of distinct model patterns, each including components corresponding to those in said engine operation pattern data and each representing a preselected engine operating condition;

means for presetting one or more reference patterns, each representative of a distinct specific engine condition and each including a proper subset of the information in said first signal;

means for comparing said engine operation pattern data with each of said reference patterns and updating said model patterns in accordance with said engine operation pattern data when said engine operation pattern data includes one of said reference patterns;

means for comparing said engine operation pattern data with each of said model patterns to judge if said engine operation pattern data approximately matches one of said model patterns; and means for performing control and fail-safe operations for the engine, normally solely on the basis of said first signal, and on the basis of said first signal and the matching one of said model patterns when the engine operation pattern approximately matches one of said model patterns.

7. An electronic engine control system for an internal combustion engine comprising:

means for monitoring preselected engine operating parameters and producing a first signal indicative thereof;

means for sampling said first signal and producing and recording engine operation pattern data including first engine operating parameter-indicative data and a second time-indicative component;

means for presetting a plurality of distinct model patterns, each including components corresponding to those in said engine operation pattern data and each representing a preselected engine operating condition;

means for comparing said engine operation pattern data with each of said model patterns to judge if said engine operation pattern data approximately matches one of said model patterns;

means for projecting probable immediate changes in engine operating conditions on the basis of the matching one of said model patterns when said engine operation pattern data matches one of said model patterns to derive a projected engine operation pattern; and means for performing control and fail-safe operations for the engine, normally solely on the basis of said first signal, and on the basis of said first signal and said projected engine operation pattern when the engine operation pattern approximately matches one of said model patterns.

8. An electronic engine control system for an internal combustion engine comprising:

means for monitoring preselected engine operating parameters and producing a first signal indicative thereof;

means for sampling said first signal and producing and recording engine operation pattern data including first engine operating parameter-indicative data and a second time-indicative component;

means for presetting a plurality of distinct model patterns, each including components corresponding to those in said engine operation pattern data and each representing a preselected engine operating condition;

means for presetting one or more reference patterns, each representative of a distinct specific engine condition and each including a proper subset of the information in said first signal;

means for comparing said engine operation pattern data with each of said reference patterns and updating said model patter in accordance with said engine operation pattern data when said engine operation pattern data includes one of said reference patterns;

means for comparing said engine operation pattern data with each of said model patterns to judge if said engine operation pattern data approximately matches one of said model patterns;

means for projecting probable immediate changes in engine operating conditions on the basis the matching one of said model patterns when said engine operation pattern data matches one of said model patterns to derive a projected engine operation pattern; and means for performing control and fail-safe operations for the engine, normally solely on the basis of said first signal, and on the basis of said first signal and said projected engine operation pattern when the engine operation pattern approximately matches one of said model patterns.

9. The engine control system as set forth in claim 1 wherein said comparing means operates at regular intervals.

10. The engine control system as set forth in claim 1 wherein said control means starts to operate at intervals varying in relation to engine rotation.

11. The engine control system as set forth in claim 1 wherein said model means records said model pattern even when power supply to the control system is terminated.

12. The engine control system as set forth in claim 11, wherein said model means incorporates a back-up power source which becomes active in response to termination of power supply to the control system to continue power supply to said model means.

13. The engine control system as set forth in claim 1 wherein said monitoring means and said comparing means operate at regular intervals, and wherein said control means starts to operate at intervals varying in relation to engine rotation.

14. The engine control system as set forth in claim 1 wherein said preset model pattern in said model means is representative of the engine operating conditions probably leading to engine stall, and said control means performs an engine stall preventing operation when said engine operation pattern data matches said preset model pattern.

15. The engine control system as set forth in claim 14, wherein said control means performs said engine stall preventing operation by increasing the rate of auxiliary air flow into the engine.

16. The engine control system as set forth in claim 14, wherein said control means performs said engine stall preventing operation by advancing the spark ignition timing in a spark ignition system.

17. The engine control system as set forth in claim 14, wherein said control means performs said engine stall preventing operation by decreasing an exhaust gas recirculation rate.

18. The engine control system as set forth in claim 14, wherein said control means performs said engine stall preventing operation by increasing an auxiliary air flow rate, advancing spark timing and decreasing an exhaust gas recirculation rate.

19. A method for controlling an automotive internal combustion engine comprising the steps of:

monitoring a preselected engine operating parameter and producing a first signal indicative thereof;

periodically sampling said first signal and producing and recording engine operation pattern data including first engine operating parameter-indicative data and a second time-indicative component;

presetting a model pattern including components corresponding to those in said engine operation pattern data and representing a preselected engine operating condition;

presetting a reference pattern representative of a specific engine condition and including a proper subset of the information in said first signal;

comparing said engine operation pattern data with said reference pattern and replacing said model pattern with said engine operation pattern data when said engine operation pattern data includes said reference pattern;

comparing said engine operation pattern data with said model pattern to judge if said engine operation pattern data approximately matches said model pattern; and performing control and fail-safe operations for the engine, normally solely on the basis of said first signal, and on the basis of said first signal and said model pattern when the engine operation pattern approximately matches said model pattern.

20. A method for controlling an automotive internal combustion engine comprising the steps of:

monitoring a preselected engine operating parameter and producing a first signal indicative thereof;

periodically sampling said first signal and producing and recording engine operation pattern data including first engine operating parameter-indicative data and a second time-indicative component;

presetting a model pattern including components corresponding to those in said engine operation pattern data and representing a preselected engine operating condition;

comparing said engine operation pattern data with said model pattern to judge if said engine operation pattern data approximately matches said model pattern;

projecting probable immediate changes in engine operating conditions on the basis of said model pattern when said engine operation pattern data matches said model pattern to derive a projected engine operation pattern; and performing control and fail-safe operations for the engine, normally solely on the basis of said first signal, and on the basis of said first signal and said projected engine operation pattern when the engine operation pattern approximately matches said model pattern.

21. A method for controlling an automotive internal combustion engine comprising the steps of:

monitoring a preselected engine operating parameter and producing a first signal indicative thereof;

periodically sampling said first signal and producing and recording engine operation pattern data including first engine operating parameter-indicative data and a second time-indicative component;

presetting a model pattern including components corresponding to those in said engine operation pattern data and representing a preselected engine operating condition;

presetting a reference pattern representative of a specific engine condition and including a proper subset of the information in said first signal;

comparing said engine operation pattern data with said reference pattern and replacing said model pattern with said engine operation pattern data when said engine operation pattern data includes said reference pattern;

comparing said engine operation pattern data with said model pattern to judge if said engine operation pattern data approximately matches said model pattern;

projecting probable immediate changes in engine operating conditions on the basis of said model pattern when said engine operation pattern data matches said model pattern to derive a projected engine operation pattern; and performing control and fail-safe operations for the engine, normally solely on the basis of said first signal, and on the basis of said first signal and said projected engine operation pattern when the engine operation pattern approximately matches said model pattern.

22. A method for controlling an automotive internal combustion engine comprising the steps of:

monitoring preselected engine operating parameters and producing a first signal indicative thereof;

sampling said first signal and producing and recording engine operation pattern data including first engine operating parameter-indicative data and a second time-indicative component;

presetting a plurality of distinct model patterns, each including components corresponding to those in said engine operation pattern data and each representing a preselected engine operating condition;

presetting one or more reference patterns, each representative of a distinct specific engine condition and each including a proper subset of the information in said first signal;

comparing said engine operation pattern data with each of said reference patterns and updating said model patterns in accordance with said engine operation pattern data when said engine operation pattern data includes one of said reference patterns;

comparing said engine operation pattern data with each of said model patterns to judge if said engine operation pattern data approximately matches one of said model patterns; and performing control and fail-safe operations for the engine, normally solely on the basis of said first signal, and on the basis of said first signal and the matching one of said model patterns when the engine operation pattern approximately matches one of said model patterns.

23. A method for controlling an automotive internal combustion engine comprising the steps of:

monitoring preselected engine operating parameters and producing a first signal indicative thereof;

sampling said first signal and producing and recording engine operation pattern data including first engine operating parameter-indicative data and a second time-indicative component;

presetting a plurality of distinct model patterns, each including components corresponding to those in said engine operation pattern data and each representing a preselected engine operating condition;

comparing said engine operation pattern data with each of said model patterns to judge if said engine operation pattern data approximately matches one of said model patterns;

projecting probable immediate changes in engine operating conditions on the basis of the matching one of said model patterns when said engine operation pattern data matches one of said model patterns to derive a projected engine operation pattern; and performing control and fail-safe operations for the engine, normally solely on the basis of said first signal, and on the basis of said first signal and said projected engine operation pattern when the engine operation pattern approximately matches one of said model patterns.

24. A method for controlling an automotive internal combustion engine comprising the steps of:

monitoring preselected engine operating parameters and producing a first signal indicative thereof;

sampling said first signal and producing and recording engine operation pattern data including first engine operating parameter-indicative data and a second time-indicative component;

presetting a plurality of distinct model patterns, each including components corresponding to those in said engine operation pattern data and each representing a preselected engine operating condition;

presetting one or more reference patterns, each representative of a distinct specific engine condition and each including a proper subset of the information in said first signal;

comparing said engine operation pattern data with each of said reference patterns and replacing said model pattern with said engine operation pattern data when said engine operation pattern data includes one of said reference patterns;

comparing said engine operation pattern data with each of said model patterns to judge if said engine operation pattern data approximately matches one of said model patterns;

projecting probable immediate changes in engine operating conditions on the basis of the matching one of said model patterns when said engine operation pattern data matches one of said model patterns to derive a projected engine operation pattern; and performing control and fail-safe operations for the engine, normally solely on the basis of said first signal, and on the basis of said first signal and said projected engine operation pattern when the engine operation pattern approximately matches one of said model patterns.

25. In an electronic control system for an internal combustion engine having an air induction system including an auxiliary air induction control means, a spark ignition system and a fuel supply system, said control system controlling an auxiliary air flow, a spark ignition, air/fuel ratio, fuel supply and other engine operation parameters, and said engine driving one or more auxiliary vehicle components, a method for detecting occurrences of preselected engine operating conditions comprising the steps of:

monitoring preselected engine operation parameters including the operating states of one or more engine accessories and said engine-driven vehicle components;

sampling said engine operation parameters and producing and recording engine operation pattern data including a first parameter-indicative component and a second time-indicative component;

presetting various model patterns, each representative of a preselected engine condition and each including components corresponding to those in said engine operation pattern data; and comparing said engine operation pattern data with each of said model patterns to judge if said engine operation pattern data matches one of said model patterns.

26. In an electronic control system for an internal combustion engine having an air induction system including an auxiliary air induction control means, a spark ignition system and a fuel supply system, said control system controlling an auxiliary air flow, a spark ignition, air/fuel ratio, fuel supply and other engine parameters, and said engine driving one or more vehicle components, a method for detecting occurrences of preselected engine operating conditions comprising the steps of:

monitoring preselected engine operation parameters including the operating states of one or more engine accessories and said engine-driven vehicle components;

sampling said engine operation parameters and producing and recording engine operation pattern data including a first parameter-indicative component and a second time-indicative component;

presetting various model patterns each representative of a preselected engine condition and each including components corresponding to those in said engine operation pattern data;

presetting various reference patterns, each representative of a preselected specific engine condition;

comparing said engine operation pattern data with each of said reference patterns to judge if said engine operation pattern data matches one of said reference patterns, and updating said model patterns in accordance with the engine operation pattern data when engine operation pattern data matches one of said reference patterns; and comparing said engine operation pattern data with each of said model patterns to judge if said engine operation pattern data matches one of said model patterns.

27. In an electronic control system for an internal combustion engine having an air induction system including an auxiliary air induction control means, a spark ignition system and a fuel supply system, said control system controlling an auxiliary air flow, a spark ignition, air/fuel ratio, fuel supply and other engine parameters, and said engine driving one or more vehicle components, a method for projecting engine behavior immediately subsequent to preselected engine conditions comprising the steps of:

monitoring preselected engine operation parameters including the operating states of one or more engine accessories and said engine-driven vehicle components;

sampling said engine operation parameters and producing and recording engine operation pattern data including a first parameter-indicative component and a second time-indicative component;

presetting various model patterns, each representative of specific engine condition and including the component corresponding to that in said engine operation parameter data;

presetting various reference patterns, each representative of a preselected engine condition;

comparing said engine operation pattern data with each of said reference patterns to judge if said engine operation pattern data matches one of said reference patterns, and updating said model patterns in accordance with the engine operation pattern data when said engine operation pattern data matches one of said reference patterns;

comparing said engine operation pattern data with each of said model patterns to judge if said engine operation pattern data matches one of said model patterns; and projecting probable engine behavior in the immediate future on the basis of the model pattern matching said engine operation pattern data.

* * * * *